US012584187B2

(12) United States Patent
Yamada et al.

(10) Patent No.: US 12,584,187 B2
(45) Date of Patent: Mar. 24, 2026

(54) METHOD FOR REMOVING PHOSPHORUS FROM PHOSPHORUS-CONTAINING SUBSTANCE, METHOD FOR MANUFACTURING RAW MATERIAL FOR METAL SMELTING OR RAW MATERIAL FOR METAL REFINING, AND METHOD FOR MANUFACTURING METAL

(71) Applicant: JFE STEEL CORPORATION, Tokyo (JP)

(72) Inventors: Rei Yamada, Tokyo (JP); Kenji Nakase, Tokyo (JP); Yoshie Nakai, Tokyo (JP); Naoki Kikuchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 1080 days.

(21) Appl. No.: 17/619,998

(22) PCT Filed: May 1, 2020

(86) PCT No.: PCT/JP2020/018445
§ 371 (c)(1),
(2) Date: Dec. 16, 2021

(87) PCT Pub. No.: WO2020/261767
PCT Pub. Date: Dec. 30, 2020

(65) Prior Publication Data

US 2022/0372591 A1 Nov. 24, 2022

(30) Foreign Application Priority Data

Jun. 25, 2019 (JP) ..... 2019-117307
Jun. 25, 2019 (JP) ..... 2019-117329

(51) Int. Cl.
*C22B 1/11* (2006.01)

(52) U.S. Cl.
CPC ..... *C22B 1/11* (2013.01)

(58) Field of Classification Search
CPC ..... C01B 21/097; C21C 7/0645; C21C 7/072; C21C 7/10; C22B 1/02; C22B 1/11
See application file for complete search history.

(56) References Cited

U.S. PATENT DOCUMENTS 11,649,514 B2 * 5/2023 Nakase ..... C21C 7/0645 75/459
2017/0349959 A1 12/2017 Nispel et al.

FOREIGN PATENT DOCUMENTS

CN 101302586 A 11/2008
CN 102126811 A 7/2011
(Continued)

OTHER PUBLICATIONS

NPL: on-line translation of CN 101302586 A,, Jul. 2008 (Year: 2008).*
(Continued)

*Primary Examiner* — Jie Yang
(74) *Attorney, Agent, or Firm* — Oliff PLC

(57) ABSTRACT

A method removes phosphorus from a phosphorus-containing substance. In the method, the phosphorus-containing substance that is used as a raw material for metal smelting or refining is reacted with a nitrogen-containing gas so that phosphorus in the phosphorus-containing substance is removed through nitriding. Prior to a treatment of a nitriding removal of phosphorus from the phosphorus-containing substance, a treatment is performed in which the phosphorus-containing substance is heated to an unmolten state temperature range so as to react with a reducing agent, thereby reducing at least a part of metal oxide in the phosphorus-containing substance.

9 Claims, 7 Drawing Sheets

(56) References Cited

FOREIGN PATENT DOCUMENTS

| | | | |
|---|---|---|---|
| CN | 102264919 | A | 11/2011 |
| CN | 105907947 | A | 8/2016 |
| CN | 108148942 | A | 6/2018 |
| CN | 109321704 | A | 2/2019 |
| EP | 2 383 352 | A1 | 11/2011 |
| EP | 3 042 965 | A1 | 7/2016 |
| EP | 3 733 882 | A1 | 11/2020 |
| JP | S47-10451 | A | 5/1972 |
| JP | S54-83603 | A | 7/1979 |
| JP | S56-075507 | A | 6/1981 |
| JP | S60-261501 | A | 12/1985 |
| JP | H08-176631 | A | 7/1996 |
| JP | 2000-119759 | A | 4/2000 |
| JP | 2017-128747 | A | 7/2017 |
| RU | 2001123 | C1 | 10/1993 |
| TW | 201627503 | A | 8/2016 |

OTHER PUBLICATIONS

Feb. 6, 2023 Office Action issued in Korean Patent Application No. 10-2021-7038818.
Jul. 18, 2022 Extended European Search Report issued in European Patent Application No. 20831257.9.
Dec. 26, 2023 Office Action and Search Report issued in Chinese Patent Application No. 202080046608.1.
Sasabe et al., "Direct Dephosphorization from Iron Ore Containing Higher Concentration of Phosphorus," Tetsu-to-Hagané, 2014, vol. 100, No. 2, pp. 217-222.
Dec. 2, 2020 Office Action issued in Taiwanese Patent Application No. 109120227.
Jul. 28, 2020 International Search Report issued in International Patent Application No. PCT/JP2020/018445.
Mar. 19, 2019 International Search Report issued in PCT Application No. PCT/JP2018/045661.
Mar. 19, 2019 Written Opinion issued in PCT Application No. PCT/JP2018/045661.
Oct. 6, 2020 Office Action issued in Japanese Patent Application No. 2019-562951.
Semin A E et al., Izvestiya Vysshikh Uchebnykh Zave denij. Chernaya Metallurgiya (1991), No. 1, 28-29, 2 pages.
May 6, 2021 Office Action issued in Chinese Patent Application No. 201880074196.5.
Feb. 9, 2021 Extended European Search Report issued in European Patent Application No. 18894911.9.
Jan. 5, 2021 Australian Examination Report issued in Australian Patent Application No. 2018394522.
Jul. 22, 2019 Office Action issued in Tiawanese Patent Application No. 107146348.
Jun. 16, 2021 Office Action issued in Korean Patent Application No. 10-2020-7011719.

* cited by examiner

METHOD FOR REMOVING PHOSPHORUS FROM PHOSPHORUS-CONTAINING SUBSTANCE, METHOD FOR MANUFACTURING RAW MATERIAL FOR METAL SMELTING OR RAW MATERIAL FOR METAL REFINING, AND METHOD FOR MANUFACTURING METAL

TECHNICAL FIELD

The present invention relates to a method for removing phosphorus from a phosphorus-containing substance, in which at least a part of phosphorus and oxide in a solid oxide (phosphorus-containing substance) that is used as a main raw material or an auxiliary raw material for metal smelting or metal refining is decreased at an early stage of the smelting or refining, a method for manufacturing a raw material for metal smelting or refining, and a method for manufacturing metal. The invention particularly proposes such methods effective in improving the quality of metal products.

Definition

As described herein, alphabetical symbols such as "P" and "$P_2O_5$" denote substances expressed respectively by such chemical formulae, and the term "phosphorus" refers to phosphorus in any form contained in those substances.

As described herein, the volume of gas, when expressed in "titers," refers to a volume value in terms of a standard state defined by a temperature of 273 K and an atmospheric pressure of 1 atm. Further, as for the pressure unit of atm, one atm equals $1.01325\times10^5$ Pa. Furthermore, the content of P in a substance, when expressed in mass %, refers to a content percentage of phosphorus in any form contained in the substance.

Background Art

Phosphorus (P) is inevitably contained in molten pig iron manufactured in a blast furnace due to an ironmaking raw material component such as iron ore. Since phosphorus is a harmful component to a steel material, it is common to perform a dephosphorization treatment generally at a steelmaking stage so as to improve material properties of iron and steel products. The dephosphorization treatment is a method for removing phosphorus in molten pig iron or molten steel by oxidizing the phosphorus by use of an oxygen source such as an oxygen gas or iron oxide to form $P_2O_5$ and then transferring $P_2O_5$ into slag whose main component is CaO, While phosphorus in molten pig iron or molten steel is oxidized using a gas such as oxygen and removed into the slag, iron is also oxidized at this time, and thus even in a case of not using iron oxide as the oxygen source, the iron in the form of iron oxide is also contained in the slag.

In recent years, from the viewpoint of environmental measures and resource saving, an attempt including recycling of steelmaking slag has been made to decrease a generation amount of steelmaking slag. For example, slag (converter slag) generated during decarburization refining of molten pig iron that has been subjected to a preliminary dephosphorization treatment (a treatment of preliminarily removing phosphorus in molten pig iron before being subjected to decarburization refining in a converter) is recycled, as a CaO source for a slag forming agent or an iron source, to a blast furnace via a sintering process of iron ore or recycled as a CaO source in a molten pig iron preliminary treatment process.

When performing decarburization relining of molten pig iron to which a preliminary dephosphorization treatment has been performed (hereinafter, referred to "dephosphorized molten pig iron"), especially dephosphorized molten pig iron to which a preliminary dephosphorization treatment has been performed to a level of the phosphorus concentration of a steel product in a converter, the molten pig iron generates a converter slag barely containing phosphorus. Accordingly, for example, even when such a converter slag is used for recycling in a blast furnace, there is no need to be concerned about an increase in a phosphorus concentration (pickup) in the molten pig iron. However, a slag generated in a preliminary dephosphorization treatment or a converter slag (slag having a high phosphorus content) generated when decarburization refining is performed in a converter to a molten pig iron in which a preliminary dephosphorization treatment has not been performed (hereinafter, sometimes abbreviated as "normal molten pig iron") or to a dephosphorized molten pig iron in which a preliminary dephosphorization treatment has been performed but the phosphorus concentration after the dephosphorization treatment is not decreased to a level of the phosphorus concentration of a steel product is used for recycling in the form of oxide in a blast furnace, phosphorus in a converter slag is reduced and manufactured in a blast furnace. Therefore, there arises a problem that a phosphorus content in a molten pig iron is increased and thus a load of molten pig iron dephosphorization treatment is rather increased.

Furthermore, manganese (Mn) is conventionally added so as to improve the strength of iron and steel products. For example, in manufacturing manganese-containing steel, as a manganese source to be added to increase an Mn concentration in molten steel, there is used, in addition to manganese ore, ferromanganese having a carbon content of 1.0 to 7.5 mass %, silicon manganese having a carbon content of not more than 2.0 mass %, metallic manganese having a carbon content of not more than 0.01 mass %, or the like. It is known, however, that a raw material price of the manganese source except for manganese ore increases with decreasing carbon content. Thus, for the purpose of decreasing a manufacturing cost, manganese ore, which is inexpensive as the manganese source, is used to produce manganese-containing steel. However, a problem is that, a particularly inexpensive type of manganese ore contains a large amount of phosphorus, so that using such a manganese as the manganese source causes an increase in phosphorus concentration in a steel material, resulting in deterioration in quality. For this reason, the use of manganese ore is in fact limited.

As described above, a large amount of phosphorus is usually contained in a main raw material or an auxiliary raw material that is used in an ironmaking process, and thus a phosphorus content in final iron and steel products is increased depending on a concentration and a use amount of phosphorus contained in such a phosphorus-containing substance. The phosphorus content affects the quality of iron and steel products. In order, therefore, to suppress a phosphorus content in iron and steel products, it is required to use a phosphorus-containing substance such as a main or auxiliary raw material having a low phosphorus content. This, however, leads to a cost increase. Thus, there have conventionally been proposed some methods for preliminarily removing phosphorus from a phosphorus-containing substance that is a main or auxiliary raw material for ironmaking.

For example, Patent Literature 1 proposes a method for removing phosphorus by bringing iron ore, titanium-containing iron ore, nickel-containing ore, chromium-containing ore or a mixture containing these types of ore as a main component having a CaO content of not more than 25 mass % and a $CaO/(SiO_2+Al_2O_3)$ ratio of not more than 5, into contact with one selected from a group of Ar, He, $N_2$, CO, $H_2$, and hydrocarbon or a mixture gas thereof at a temperature of not lower than 1600° C.

Patent Literature 2 proposes the following method. That is, phosphate is separated and dissolved by: crushing iron ore having a high phosphorus content to a size of not more than 0.5 mm; adding water to the resultant to have a pulp concentration of about 35 mass %; and adding $H_2SO_4$ or HCl to the solution and reacting therewith at pH: not more than 2.0. Then, non-magnetic $SiO_2$, $Al_2O_3$ and so on are precipitated and separated as slime by gathering a magnetically attracted substance such as magnetite and so on by means of a magnetic separation, while P dissolved into the solution is neutralized in a range of pH: 5.0 to 10.0 by adding slaked lime or quicklime so as to separate and collect as calcium phosphate.

Patent Literature 3 proposes a method for performing dephosphorization of iron ore by use of Microbial *Aspergillus* SP KSC-1004 strain or Microbial *Fusarium* SP KSC-1005 strain.

Non-Patent Literature 1 reports a study on reduction of high-phosphorus iron ore by use of a hydrogen-vapor mixture gas in which a water vapor pressure is controlled, thus proposing a method for performing dephosphorization directly from iron ore.

CITATION LIST

Patent Literature

Patent Literature 1: Japanese Patent Laid-Open No. 54-83603

Patent Literature 2: Japanese Patent Laid-Open No. 60-261501

Patent Literature 3: Japanese Patent Laid-Open No. 2000-119759

Non-Patent Literature

Non-Patent literature 1: Iron and Steel, Vol. 10 (2014), No. 2, p. 325

SUMMARY OF INVENTION

Technical Problem

The above-described conventional techniques, however, have the following problems to be solved. That is, the method disclosed in Patent Literature 1 presents a problem of a treatment temperature of as high as not lower than 1600° C., resulting in the need for a large amount of energy. Moreover, since ore is treated in a molten state, there are also problems of wear of a vessel and handling difficulty of a high-temperature melt.

The method disclosed in Patent Literature 2 is a wet treatment using acid, presenting a problem of time-consuming and costly drying of a magnetically attractable substance recovered so that the substance can be used as a main raw material. Another problem is that preliminarily pulverizing iron ore to a size of not more than 0.5 mm is time-consuming and costly.

The method of Patent Literature 3 is also a wet treatment, presenting a problem of time-consuming and costly drying of ore after removal of phosphorus therefrom so that the ore can be used as a main raw material.

Non-Patent Literature 1 presents a problem of a removal ratio of phosphorus in ore of as low as 13% at the maximum. Another problem is that, while hydrogen is used as a reaction gas, no consideration has been made on equipment and so on for safely treating the hydrogen on an industrial scale.

The present invention has been made to overcome the above-described problems with the conventional techniques. An object of the present invention is to propose a method for removing phosphorus from a phosphorus-containing substance, which is applicable on an industrial scale, so as to effectively decrease phosphorus contained in a phosphorus-containing substance, which is a solid oxide that is used as a main raw material or an auxiliary raw material for metal smelting or metal refining, a method for manufacturing a raw material for metal smelting or refining, and a method for manufacturing metal.

Solution to Problem

While examining the above-described problems with the conventional techniques, the inventors found out that phosphorus can be efficiently removed by heating a phosphorus-containing substance at a low temperature and bringing it into contact with a nitrogen-containing gas, which has led to the development of the present invention.

The present invention is developed based on this finding, and firstly provides a method for removing phosphorus from a phosphorus-containing substance in which the phosphorus-containing substance that is used as a raw material for metal smelting or metal refining is reacted with a nitrogen-containing gas so that phosphorus in the phosphorus-containing substance is removed through nitriding. In the method, prior to a nitriding removal treatment of phosphorus from the phosphorus-containing substance, a reduction treatment is performed in which the phosphorus-containing substance is heated to an unmolten state temperature range so as to react with a reducing agent, thereby reducing at least a part of metal oxide in the phosphorus-containing substance.

The method for removing phosphorus from a phosphorus-containing substance according to the first method of the present invention, which is configured as described above, is also conceived to be a more preferred embodiment when configured as follows:

a. The reducing agent has an equilibrium oxygen partial pressure of not more than $10^{-1}$ atm determined by the reducing agent and a product resulting from complete combustion of the reducing agent at a treatment temperature of the reduction treatment.

b. A treatment temperature Tr (° C.) of the reduction treatment satisfies a condition of Expression (1) below (in Expression (1), $T_m$ denotes a melting point (° C.) of the phosphorus-containing substance).

$$300 \leq T_r \leq 0.95 = T_m \quad (1)$$

c. A reduction ratio of iron oxide and manganese oxide in the phosphorus-containing substance at the end of the reduction treatment is set to not less than 11% and less than 33%, where the iron oxide represents any of or a mixture of FeO, $Fe_3O_4$, and $Fe_2O_3$, the manganese oxide represents any of or a mixture of MnO, $Mn_3O_4$, $Mn_2O_3$, and $MnO_2$ and the reduction ratio refers to a ratio of an amount of oxygen removed by reduction to total oxygen in the iron oxide and the manganese oxide.

d. The reducing agent is a reducing gas or a solid reducing agent.

e. The reduction treatment using the reducing gas is performed in a range of Expression (2) below (in Expression (2), x denotes twice (–) a volume ratio of an oxygen gas in a standard state required for complete combustion of a unit volume of the reducing gas in the standard state, and Q denotes an amount of the reducing gas ($Nm^3$/kg) used for the reduction treatment with respect to a total amount of the iron oxide and the manganese oxide in the phosphorus-containing substance).

$$1.5 \leq x \times Q \leq 6.0 \quad (2)$$

f. The reduction treatment using the solid reducing agent satisfies a condition of Expression (3) below (in Expression (3), $M_M$ denotes a molar mass (kg/mol) of a solid reducing agent M, $M_{Fe2O3}$ denotes a molar mass (kg/mol) of $Fe_2O_3$, $M_{Mn2O3}$ denotes a molar mass (kg/mol) of M, $Mn_2O_3$, $W_M$ denotes a mass (kg) of the solid reducing agent M, $W_{Fe2O3}$ denotes a mass (kg) of $Fe_2O_3$ in the phosphorus-containing substance, $W_{Mn2O3}$ denotes a mass (kg) of $Mn_2O_3$ in the phosphorus-containing substance, and y denotes an amount of substance (mol) of an oxygen atom that reacts with 1 mol of the solid reducing agent M).

$$\frac{1}{3y} \leq \frac{W_M}{M_M} \Big/ \left( \frac{W_{Fe_2O_3}}{M_{Fe_2O_3}} + \frac{W_{Mn_2O_3}}{M_{Mn_2O_3}} \right) \leq \frac{1}{y} \quad (3)$$

g. The nitriding removal from the phosphorus-containing substance is a treatment in which the phosphorus-containing substance is heated to an unmolten state temperature so as to react with a nitrogen-containing gas having a nitrogen partial pressure of more than 0.15 atm and less than 0.95 atm, thereby removing at least a part of phosphorus in the phosphorus-containing substance therefrom into a gas phase.

h. The nitriding removal from the phosphorus-containing substance is a treatment in which the phosphorus-containing substance is heated to the unmolten state temperature so as to react with a nitrogen-containing gas having a nitrogen partial pressure of more than 0.15 atm and less than 0.95 atm, thereby removing at least a part of phosphorus in the phosphorus-containing substance therefrom as a PN gas.

The present invention secondly proposes a method for manufacturing a raw material for metal smelting or a raw material for metal refining including, in manufacturing the raw material for metal smelting or the raw material for metal refining, a step of decreasing a phosphorus content in a phosphorus-containing substance by use of the method for removing phosphorus from a phosphorus-containing substance, which is the above-described first method according to the present invention.

The present invention thirdly proposes a method for manufacturing metal, in which in manufacturing the metal via at least one of a smelting step or a refining step, the raw material for metal smelting obtained by the second method according to the present invention is used to perform smelting in the smelting step or the raw material for metal refining obtained by the second method according to the present invention is used to perform refining in the refining step.

As described herein, the unmolten state refers to a state at a temperature lower than the temperature (melting point) $T_m$ at which a solid sample is transformed into a liquid, which can be easily determined by any of first to third methods described below and thus is desirable. There is, however, no limitation only to these methods.

a. The first method is that a solid sample is charged into a vessel such as crucible and then continuously observed while heated at a heating rate of 5° C./minute, preferably not more than 1° C./minute, in an electric resistant furnace or the like under an objected gas atmosphere; the temperature at which a gap between particles of the solid sample is vanished and a smooth surface is generated on a surface is determined as the melting point.

b. The second method is that a measurement is performed by heating at a heating rate of 5° C./minute preferably not more than 1° C./minute under an objected gas atmosphere by means of a differential thermal analysis; a temperature at a minimum point of the endothermic peak is determined as the melting point. Here, in the case that a plurality of endothermic peaks is generated, the method is performed by: stopping the measurement at a temperature at which respective endothermic peaks are generated; observing an appearance of the measurement sample; and determining the lowest temperature at a minimum point of the endothermic peak among temperatures at which a gap between particles of the solid sample is vanished and a smooth surface is generated on a surface, as the melting point.

c. The third method is that a liquid phase ratio is calculated by inputting a sample component and varying a temperature by means of thermodynamic calculation software of a computer; a temperature at which a liquid phase ratio exceeds 95% is determined as the melting point.

Advantageous Effects of Invention

According to the present invention, firstly, a phosphorus-containing substance that is used as a main raw material or an auxiliary raw material for metal smelting or metal refining is reacted, while being heated to an unmolten state temperature, with a reducing agent so that a reduction treatment of oxide in the phosphorus-containing substance is performed. This efficiently facilitates a subsequent nitriding dephosphorization treatment of removing, by use of nitrogen, phosphorus in the phosphorus-containing substance into a gas phase. The nitriding dephosphorization treatment of removing phosphorus in the phosphorus-containing substance into a gas phase is, for example, a nitriding dephosphorization treatment in which phosphorus in the phosphorus-containing substance is removed as a mononitride gas (PN) into a gas phase. Thus, according to the present invention, it is possible to use an increased amount of an inexpensive phosphorus-containing substance (a main raw material or an auxiliary raw material for smelting or refining) and to greatly decrease a load of a dephosphorization treatment process in a metal smelting or metal refining process.

According to the present invention, since phosphorus can be efficiently removed from a by-product such as steelmaking slag, the by-product can be reused during its generation process, and thus it is possible to reduce the amount of the auxiliary raw material usage in the dephosphorization treatment process in a metal smelting or metal refining process and suppress the generation amount of the by-product.

According to the present invention, phosphorus removed through nitriding is oxidized in an exhaust gas and formed into $P_2O_5$, which leads to recovery of dust having a high phosphorus concentration, and thus there is also an effect that effective utilization leading to recycling of phosphorus is enabled.

DESCRIPTION OF EMBODIMENT

Figure 1:
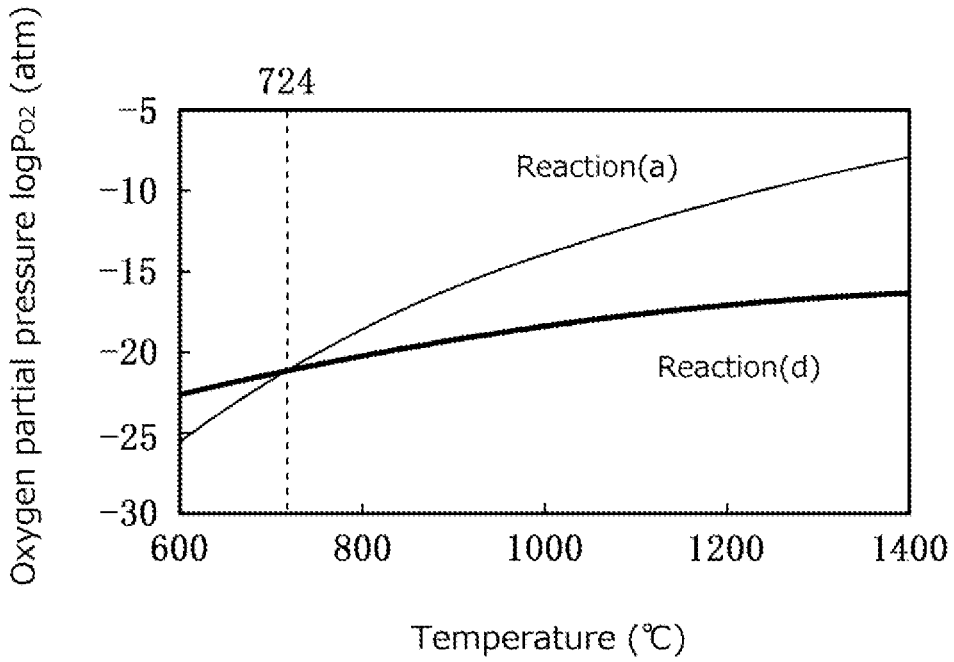
FIG. 1 is a diagram showing a relation between a treatment temperature T (° C.) and an oxygen partial pressure (log $P_{O2}$) when equilibrium of each reaction is established for a reaction (a) for removing phosphorus as a gas of PN and an equilibrium reaction (d) between solid carbon and a carbon monoxide gas.

In developing the present invention, the inventors focused on inexpensive substances having a high phosphorus concentration as main raw material and auxiliary raw material for metal smelting or metal refining and pursued a study on a method for preliminarily removing phosphorus from such phosphorus-containing substances prior to the smelting or refining using the substances.

The phosphorus-containing substances that are used as raw material (main raw material and auxiliary raw material) for metal smelting or metal refining contain phosphorus mainly as an oxide such as $P_2O_5$ and usually contain, in addition thereto, metal oxides such as CaO, $SiO_2$, MgO, $Al_2O_3$, MnO, $Mn_2O_3$, FeO, and $Fe_2O_3$. Examples of such raw material for metal smelting or metal refining, particularly raw material for ironmaking, include iron ore, manganese ore, or steelmaking slag. Table 1 shows typical compositions thereof.

TABLE 1

| | CaO | $SiO_2$ | MgO | $Al_2O_3$ | T. Mn | T. Fe | $P_2O_5$ |
|---|---|---|---|---|---|---|---|
| Iron ore | — | 3.5 | — | 1.4 | — | 63.0 | 0.2 |
| Manganese ore | 0.4 | 4.1 | 0.2 | 8.1 | 50.1 | 0.8 | 0.2 |
| Steelmaking slag | 41.0 | 13.8 | 6.1 | 5.6 | 1.6 | 18.7 | 1.6 |

As mentioned above, the main raw material and the auxiliary raw material for metal smelting and metal refining (hereinafter, an explanation will be made taking "a raw material for iron- and steel-making" as an example) comprises various metal oxides. Since phosphorus has a weak affinity with oxygen compared to calcium (Ca) and silicon (Si), it is known that $P_2O_5$ in the phosphorus-containing substance is easily reduced in a reduction of the phosphorus-containing substance by carbon, silicon, aluminum and so on. On the other hand, iron is included in various raw materials for iron- and steel-making as an oxide in the form of FeO or $Fe_2O_3$ (hereinafter, abbreviated as "FexO"). Since the affinity of these iron oxides with oxygen is comparable to that of phosphorus, FexO is reduced at the same time when the phosphorus-containing substance is reduced by carbon, silicon, aluminum and so on. In this regard, manganese is included as an oxide in the form of MnO, $Mn_2O_3$ or $MnO_2$ (hereinafter, abbreviated as "MnxO"). Since the oxide of manganese is strong in affinity with oxygen compared to that with phosphorus but weak compared to that with carbon, silicon, aluminum and so on, MnxO is also reduced together with phosphorus when the phosphorus-containing substance is reduced by these substances.

Phosphorus, however, has a high solubility into iron or manganese, and especially, phosphorus formed by reduction is quickly dissolved into iron or manganese that are formed through reduction, thus forming a high phosphorus-containing iron or a high phosphorus-containing manganese.

Therefore; the method for removing phosphorus formed by reduction presents a problem that a phosphorus removal ratio is low because phosphorus is absorbed and dissolved into iron and manganese which are valuable components.

As a result of diligent research to solve the problem, the inventors have found out that it is possible to perform a treatment under a temperature and oxygen partial pressure at which a metal iron and a metal manganese are not formed by removing phosphorus as a gas of nitride, and whereby absorption of phosphorus into iron and manganese can be suppressed.

That is, the inventors have confirmed, by a thermodynamic consideration, that a reaction (a) represented by the following chemical equation 1 that removes phosphorus present as $P_2O_5$ in a phosphorus-containing substance is removed as a gas of nitride such as, for example, a gas of phosphorus mononitride (PN) is more stable than reactions (b) and (c) described in the following chemical equations 2 and 3, respectively, in which iron oxide or manganese oxide included in the phosphorus-containing substance are reduced to form a metal iron or a metal manganese, respectively.

[Chemical Formula 1]

$$2/5P_2O_5(l)+2/5N_2(g)=4/5PN(g)+O_2(g) \quad (a)$$

[Chemical Formula 2]

$$2FeO(s)=2Fe(s)+O_2(g) \quad (b)$$

[Chemical Formula 3]

$$2\ MnO(s)=2Mn(s)+O_2(g) \quad (c)$$

FIG. 1 shows a relation between a temperature and an oxygen partial pressure when equilibrium is established for the above-described reaction (a) expressed by Chemical Formula 1. FIG. 1 also shows, for a comparison purpose, a relation between a temperature and an oxygen partial pressure determined by equilibrium between solid carbon and a carbon monoxide gas (a reaction (d) expressed by Chemical Formula 4). Here, it is assumed that an activity of $P_2O_5$ is 0.001, an $N_2$ partial pressure is 0.9 atm, a PN partial pressure is 0.001 atm, an activity of C is 1, and a CO partial pressure is 1 atm.

[Chemical Formula 4]

$$2CO(g)=2C(s)+O_2(g) \quad (d)$$

In FIG. 1, in a region where a temperature and an oxygen partial pressure are beneath respective lines of the reactions (a) and (d), the reaction progresses to the right side in (a) and (d). That is, in order to achieve a nitriding removal of phosphorus in the reaction (a), it is necessary to control the oxygen partial pressure to not more than $2.2\times10^{-19}$ atm at 800° C., not more than $1.45\times10^{-14}$ atm at 1000° C. and not more than $4.66\times10^{-11}$ atm at 1200° C.

Here, in order to reduce the oxygen partial pressure, it is effective that an element such as a single element of Ca, Mg, Al, Ti, Si, C or the like, which is stable when formed into an oxide, is coexistent. The single metallic element, however, is expensive and requires an increased reaction time. Thus, in the present invention, from the viewpoint of decreasing treatment cost and treatment time, it is preferable to decrease the oxygen partial pressure by use of carbon (C). This can be understood also from the diagram of FIG. 1 in which the oxygen partial pressure achieved by solid carbon at a temperature of not lower than 724° C. has a value sufficient for the reaction (a) of nitriding removal of phosphorus to progress.

Furthermore, in reduction reactions of $Fe_2O_3$ and $Mn_2O_3$ in the phosphorus-containing substance, a partial pressure of oxygen resulting from reactions (e) and (f) below in which these metal oxides are reduced to form $Fe_3O_4$ and $Mn_3O_4$, is higher than that in the reaction (a). That is, under a condition that $Fe_2O_3$ and $Mn_2O_3$ remain, the reaction (a) in which phosphorus is removed as phosphorus mononitride does not progress, and thus it is effective to preliminarily perform reduction treatments to reduce these oxides, whereby case the reaction (a) is expected to be further promoted. In order for reduction of $Fe_2O_3$ to progress, it is required that, by use of a reducing agent, the oxygen partial pressure in an atmosphere be made lower than an equilibrium oxygen partial pressure determined for the reaction (e) at a treatment temperature Tr. Accordingly, there is used, as the reducing agent, a gas having an equilibrium oxygen partial pressure lower than an equilibrium oxygen partial pressure determined for the reaction (e) at the treatment temperature Tr or a solid capable of reducing the equilibrium oxygen partial pressure, Here, the equilibrium oxygen partial pressure of the reducing agent is determined by the treatment temperature Tr, a partial pressure or an activity of the reducing agent and a partial pressure or an activity of a product, Here, from the viewpoint of decreasing treatment cost and treatment time, it is desirable and effective to use, as the reducing agent, a reducing gas or a solid reducing agent such as, for example, carbon monoxide (CO), hydrocarbon ($C_xH_y$), hydrogen ($H_2$), or a carbonaceous material, though there is no limitation to these examples.

Figure 2:
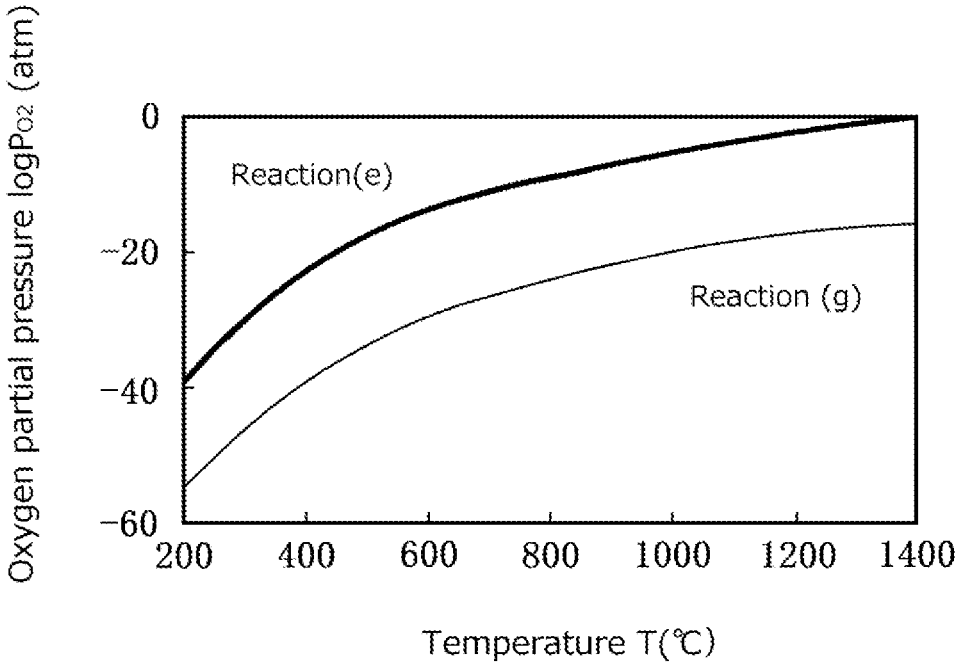
FIG. 2 is a diagram showing a relation between the treatment temperature T (° C.) and the oxygen partial pressure (log $P_{O2}$) when equilibrium of each reaction is established for a reaction (e) in which $Fe_2O_3$ is reduced to $Fe_3O_4$ and an equilibrium reaction (g) between a hydrogen gas and a water vapor gas.

FIG. 2 shows a relation between a temperature and an oxygen partial pressure when equilibrium is established for a reaction (g) in which $H_2$ is completely combusted into $H_2O$, together with a reaction (e). Here, it is assumed that an $H_2$ partial pressure is 0.9 and an $H_2O$ partial pressure is 0.001 atm. In FIG. 2, in a region defined by temperature and oxygen partial pressure values beneath a line of each of the reactions (e) and (g), the each of the reactions (e) and (g) progresses to the right side. That is, in order for $Fe_2O_3$ in the reaction (e) to be reduced to $Fe_3O_4$, it is required that the oxygen partial pressure be not more than $8.9\times10^{-30}$ atm at 300° C. and not more than $1.0\times10^{-1}$ atm at 1300° C., whereas the oxygen partial pressure determined for the reaction (g) is $6.3\times10^{-46}$ atm at 300° and $3.1\times10^{-17}$ atm at 1300° C., and thus $Fe_2O_3$ can be reduced to $Fe_3O_4$ at either of these temperature values.

[Chemical Formula 5]

$$6\ Fe_2O_3(s)=4Fe_3O_4(s)+O_2(g) \quad (e)$$

[Chemical Formula 6]

$$6Mn_2O_3(s)=4Mn_3O_4(s)+O_2(g) \quad (f)$$

[Chemical Formula 7]

$$2H_2O(g)=2H_2(g)+O_2(g) \quad (g)$$

Thus, based on the above-described results of examination, the inventors performed an experiment to confirm whether or not phosphorus is removed through nitriding. In this experiment, 10 g of iron ore whose particle size was adjusted to 1 to 3 mm was used as a phosphorus-containing substance, and 5 g of reagent carbon (having a particle size of under 0.25 mm) was used as solid carbon. Then, they were put on different boats made of alumina and placed stably in a compact electric resistance furnace. The furnace was heated to a predetermined temperature (600 to 1400° C.) while an Ar gas was supplied thereinto at 1 liter/min, after which the supply of the Ar gas was stopped and followed by supply of a mixture gas of carbon monoxide (CO) and nitrogen ($N_2$), instead of the Ar gas, at 3 liter/min; and the temperature was maintained constant for 60 minutes. In this case, a ratio of the mixture gas between carbon monoxide and nitrogen was made to vary so that a nitrogen partial pressure $P_{N2}$ fell within a range of 0 to 1 atm. After a lapse of a predetermined time, the supply of the mixture gas of carbon monoxide and nitrogen was stopped and followed by supply of an Ar gas instead at 1 liter/min, and after a temperature decrease to room temperature, the iron ore was collected. In this experiment, the gases were supplied from an upstream side on which the reagent carbon was placed stably so that the carbon monoxide gas reacted with the reagent carbon first.

Figure 3:
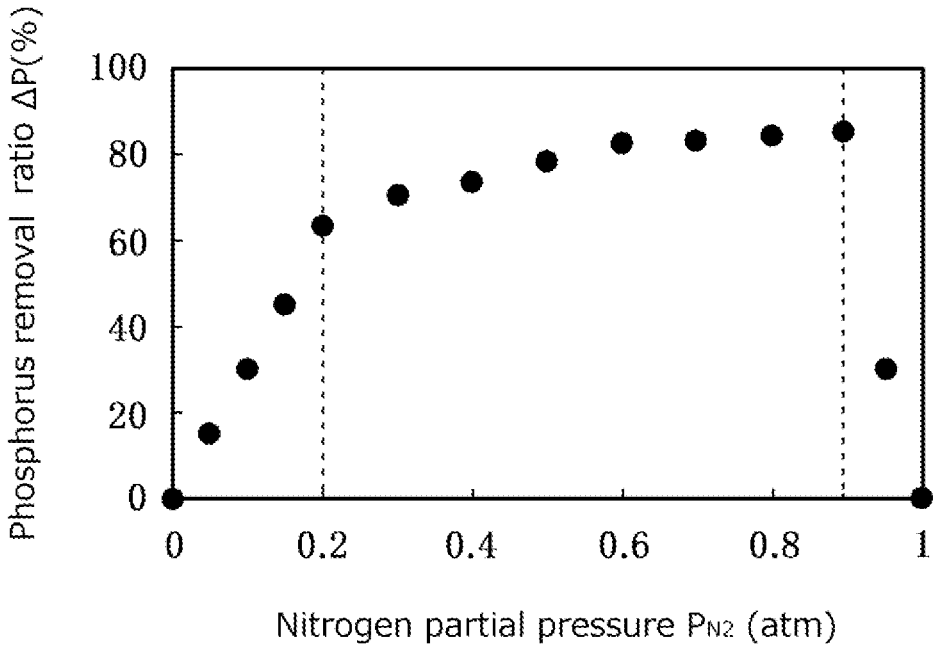
FIG. 3 is a diagram showing a relation between a phosphorus removal ratio (ΔP) in iron ore and a nitrogen partial pressure ($P_{N2}$) at a treatment temperature $T_{DP}$=1000° C.

FIG. 3 shows a relation between a phosphorus removal ratio (ΔP={(P concentration before experiment)−(P concentration after experiment)}/(P concentration before experiment)) (%) and a nitrogen partial pressure ($P_{N2}$) (atm), which is obtained from a result of a composition analysis of iron ore before and after the above-described treatment was carried out at 1000° C. As can be seen from FIG. 3, phosphorus is removed from the phosphorus-containing substance except when the nitrogen partial pressure ($P_{N2}$) is 0 atm and 1 atm, and particularly in a range of more than 0.15 atm and less than 0.95 atm, a phosphorus removal ratio as high as not less than 60% is obtained. Preferably, the nitrogen partial pressure ($P_{N2}$) is in a range of 0.2 to 0.9 atm. Conceivably, the reason why the phosphorus removal ratio is low when the nitrogen partial pressure is not more than 0.15 atm is that the nitrogen partial pressure was too low, so that phosphorus removal by the reaction (a) did not progress sufficiently within a predetermined treatment time. Furthermore, conceivably, when the nitrogen partial pressure was not less than 0.95 atm, an amount of a CO gas supplied was small, so that the oxygen partial pressure was increased due to oxygen resulting from thermal decomposition of iron oxide in the iron ore, suppressing the reaction (a) of nitriding removal of phosphorus. This can be understood also from the fact that phosphorus cannot be removed by supplying a 100% nitrogen gas ($P_{N2}$=1 atm).

Figure 4:
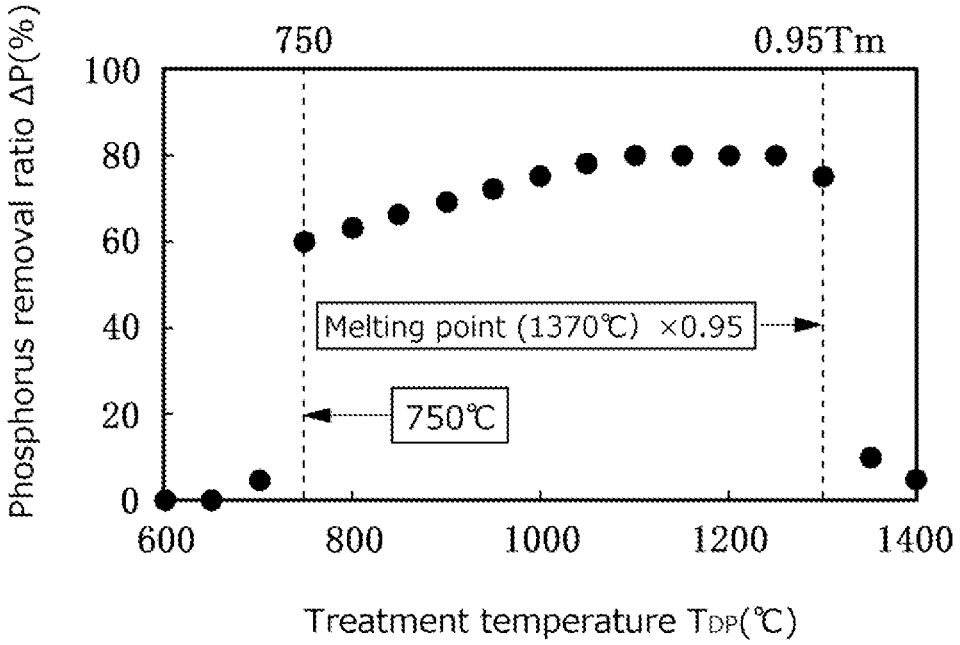
FIG. 4 is a diagram showing a relation between the phosphorus removal ratio (ΔP) in iron ore and the treatment temperature $T_{DP}$ (° C.) at $P_{co}$=0.1 atm and $P_{N2}$=0.9 atm.

FIG. 4 shows a relation between the phosphorus removal ratio ΔP (%) and a treatment temperature $T_{DP}$, (° C.), which is obtained from a result of a composition analysis of iron ore before and after the experiment in which the treatment was carried out using a mixture gas of CO=vol % ($P_{co}$ 0.1 atm) and $N_2$=90 vol % ($P_{N2}$=0.9 atm). As can be seen from FIG. 4, a high phosphorus removal ratio is obtained at 750 to 1300° C., and thus it can be understood that this temperature range is preferable for nitriding removal of phosphorus. The reason why the phosphorus removal ratio ΔP is low at a temperature of lower than 750° C. is considered partly because, as shown in FIG. 1, at a temperature of not higher than 724° C., an oxygen partial pressure required for nitriding removing of phosphorus could not be achieved using solid carbon. Furthermore, conceivably, the reason why it is low at 1350° C. and 1400° C. is that the iron ore was in a state ranging from a semi-molten state to a molten state, and a recovered sample was aggregated, so that gaps and pores between iron ore particles disappeared to significantly reduce an interfacial area for contacting gas. In this regard, a melting point ($T_m$) of iron ore measured by the differential thermal analysis method is 1370° C., and a high phosphorus removal ratio was obtained at a temperature of 1300° C., which is 0.95 times the melting point. Thus, it is considered preferable to set the treatment temperature to not higher than "0.95×$T_m$(° C.)" in order to maintain a reaction interfacial area for removing phosphorus.

Next, a small-scale experiment was performed to confirm whether or not phosphorus is removed through nitriding when the nitriding dephosphorization treatment is carried out after a reduction treatment using the reducing gas. In this experiment, 20 g or 40 g of iron ore was put on a boat made of alumina and subjected first to the reduction treatment and then to the nitriding dephosphorization treatment. In the reduction treatment, a flow rate of a carbon monoxide (CO) gas and a treatment time were adjusted so that a reducing gas unit consumption x×Q was 0.3 to 9.0 in the iron ore, and the temperature was set to 1000° C. Here, x denotes twice (−) a volume ratio of an oxygen gas in a standard state required for complete combustion of a unit volume of reducing gas in the standard state, and when CO is used as the reducing gas, since CO reacts with ½$O_2$ to form $CO_2$, x ½×2=1 is established. Furthermore, Q denotes an amount of the reducing gas ($Nm^3$/kg) used for the reduction treatment with respect to a total amount of $Fe_2O_3$ and $Mn_2O_3$ in a phosphorus-containing substance. After that, the nitriding dephosphorization treatment was carried out at a temperature of 1000° C. under an atmosphere in which a ratio of a CO gas flow rate to a $CO_2$ gas flow rate was 2 and $N_2$=80 vol % (nitrogen partial pressure=0.8 atm).

Figure 5:
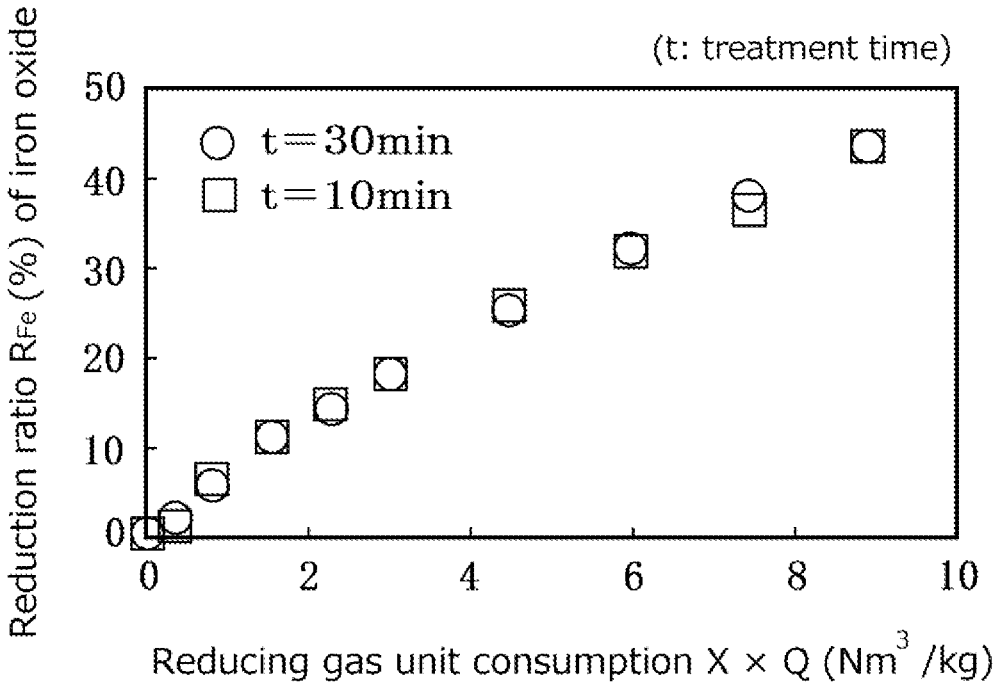
FIG. 5 is a diagram showing a relation between a reducing gas unit consumption x×Q and a reduction ratio $R_{Fe}$ (%) of iron oxide.
Figure 6:
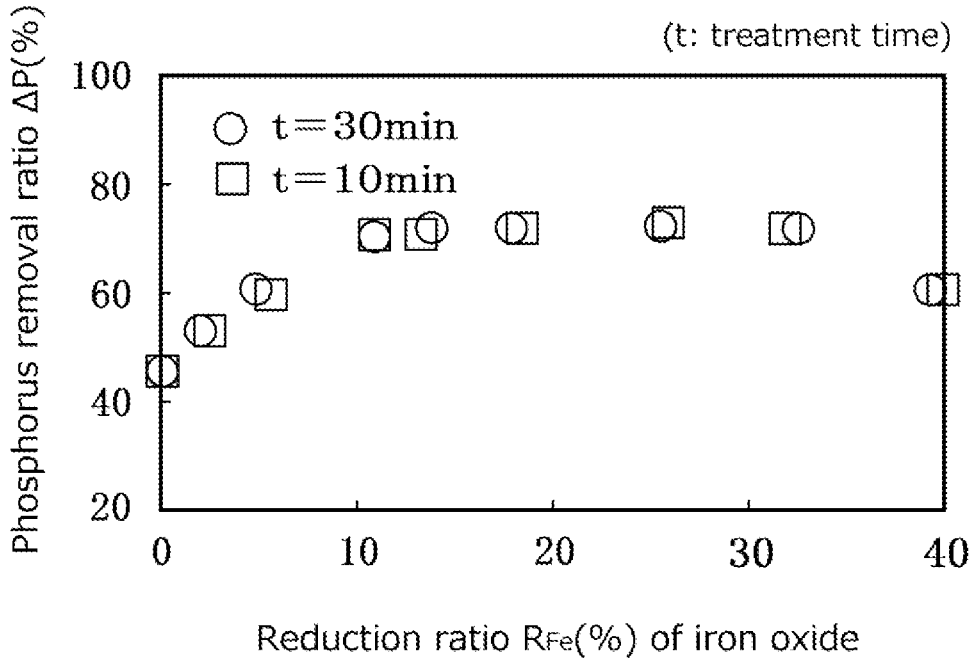
FIG. 6 is a diagram showing a relation between the reduction ratio $R_{Fe}$ of iron oxide and the phosphorus removal ratio ΔP.

FIGS. 5 and 6 show a relation between a reduction ratio $R_{Fe}$ (%) of iron oxide and the reducing gas unit consumption x×Q and a relationship between the phosphorus removal ratio ΔP (%) and the reduction ratio $R_{Fe}$ of iron oxide, respectively, which are obtained from a result of an analysis before and after a nitriding dephosphorization treatment when 20 g of iron ore is subjected to a reduction treatment for a treatment time of 30 minutes or 10 minutes. Here, the reduction ratio of iron oxide refers to a ratio of an amount of reduced oxygen to total oxygen in the iron oxide. Furthermore, the phosphorus removal ratio refers to a ratio of an amount of phosphorus removed after the reduction treatment to a total amount of phosphorus in the iron ore. Further, FIGS. 5 and 6 also show results in a case where the reduction treatment s not performed (the reduction ratio of iron oxide is 0%).

As a result, as is clear from FIG. 5, the reduction ratio $R_{Fe}$ of iron oxide increases with increasing reducing gas unit consumption x×Q. Furthermore, as is clear from FIG. 6, it can be seen that in a case where the reduction treatment is performed, the phosphorus removal ratio ΔP is increased as compared with the case where the reduction treatment is not performed. Particularly in a case where the reduction ratio $R_{Fe}$ of iron oxide is 11 to 33%, the phosphorus removal ratio ΔP is high. At this time, the reducing gas unit consumption x×Q is 1.5 to 6.0. Conceivably, the reason why the phosphorus removal ratio ΔP is low when the reduction ratio $R_{Fe}$ of iron oxide is less than 11% is that $Fe_2O_3$ remained after the reduction treatment, and thus the reaction (a) was suppressed until the reaction (e) progressed. Furthermore, conceivably, when the reduction ratio $R_{Fe}$ of iron oxide was larger than 33%, a part of the iron oxide was reduced to metallic iron, which then absorbed vaporized phosphorus, resulting in lowering the phosphorus removal ratio.

Figure 7:
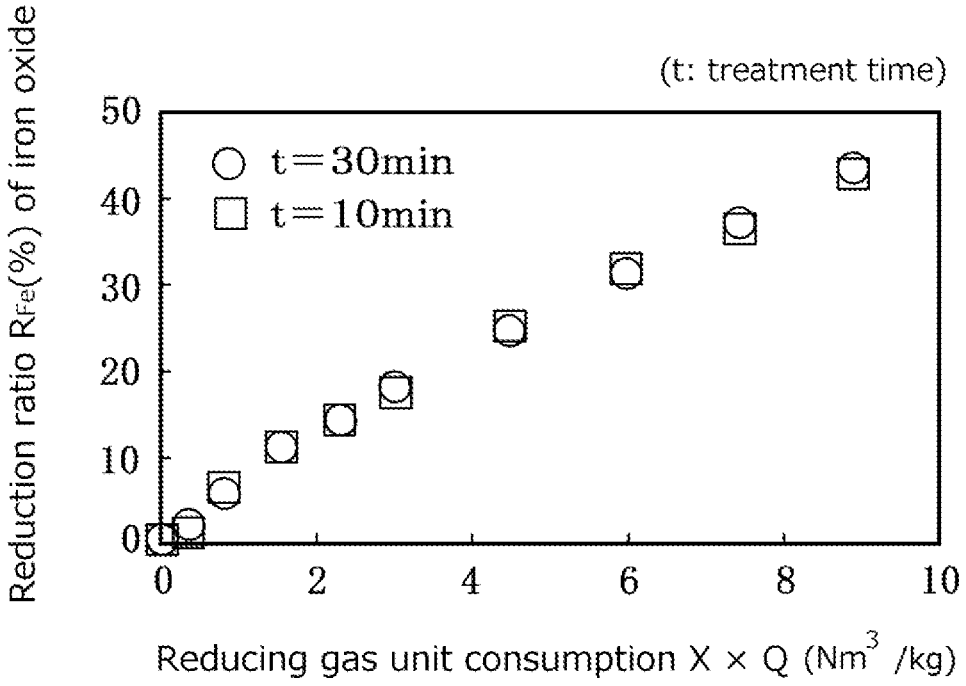
FIG. 7 is a diagram showing a relation between the reducing gas unit consumption x×Q and the reduction ratio $R_{Fe}$ of iron oxide.

Furthermore, after 40 g of iron ore was subjected to a reduction treatment at a temperature of 1000° C. for a treatment time of 30 minutes or 10 minutes, a nitriding dephosphorization treatment was performed as in the above-described case where 20 g of iron ore was subjected to the reduction treatment for a treatment time of 30 minutes or 10 minutes. FIG. 7 shows a relation between the reducing gas unit consumption x×Q and the reduction ratio $R_{Fe}$ (%) of iron oxide. FIG. 7 also shows a result in a case where the reduction treatment is not performed (the reduction ratio of iron oxide is 0%). Also in this case, as in the above-described case where 20 g of iron ore was subjected to the reduction treatment for a treatment time of 30 minutes or 10 minutes, the reduction ratio $R_{Fe}$ of iron oxide is 11 to 33% when the reducing gas unit consumption x×Q is 1.5 to 6.0. Furthermore, in a case where a nitriding dephosphorization treatment as in the above-described case is performed after the reduction treatment, the phosphorus removal ratio ΔP is high when the reduction ratio $R_{Fe}$ of iron oxide is 11 to 33%.

Figure 8:
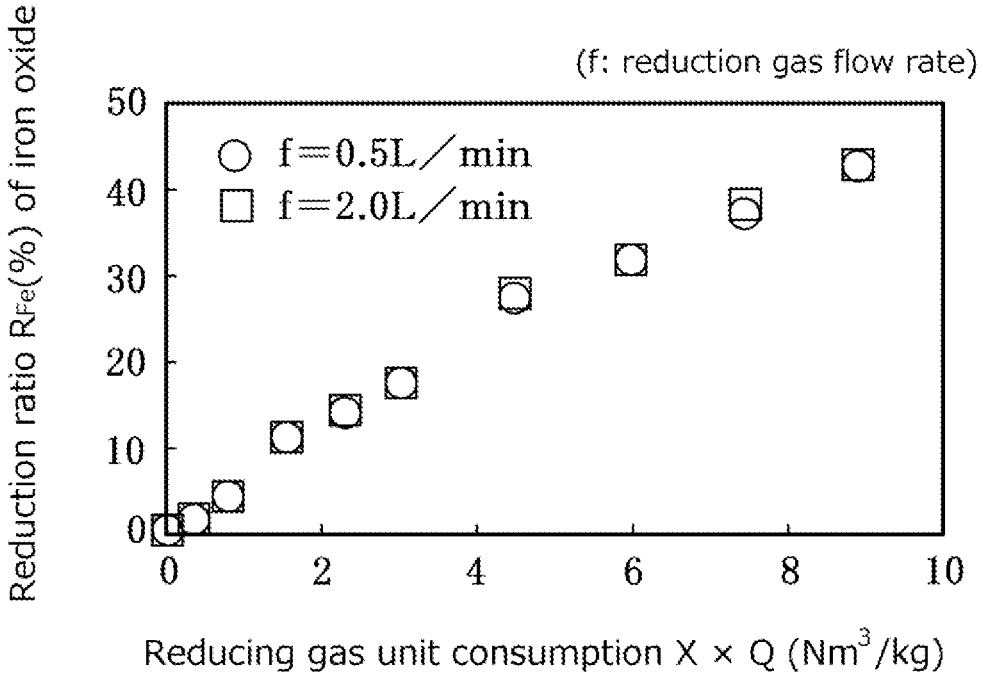
FIG. 8 is a diagram showing a relation between the reducing gas unit consumption x×Q and the reduction ratio $R_{Fe}$ of iron oxide.
Figure 9:
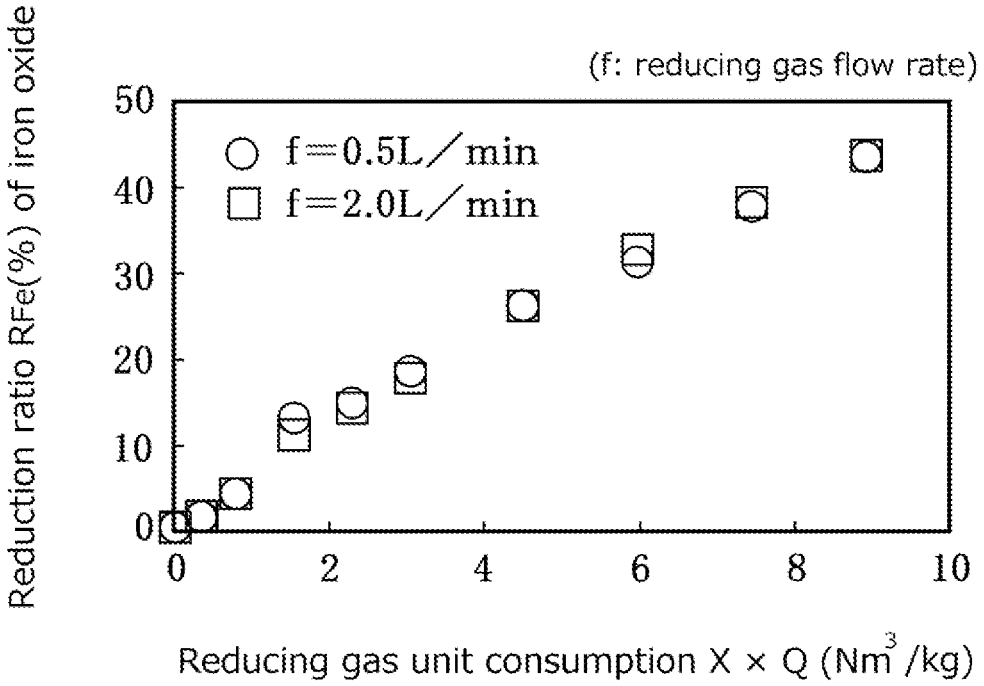
FIG. 9 is a diagram showing a relation between the reducing gas unit consumption x×Q and the reduction ratio $R_{Fe}$ of iron oxide.

FIG. 8 shows a relation between the reduction ratio $R_{Fe}$ of iron oxide and the reducing gas unit consumption x×Q in a case where 20 g of iron ore is subjected to a reduction treatment at a temperature of 1000° C., in which a reducing gas flow rate is set to 0.5 L/min or 2.0 L/min, and FIG. 9 shows the same relationship in a case where 40 g of iron ore is subjected to a reduction treatment at a temperature of 1000° C., in which the reducing gas flow rate is set to 0.5 L/min or 2.0 L/min. FIGS. 8 and 9 also show results in a case where the reduction treatment is not performed (the reduction ratio of iron oxide is 0%). Also in these cases, as in the above-described case where the reducing gas unit consumption x×Q was made to vary with the treatment time set to be constant, the reduction ratio $R_{Fe}$ of iron oxide is 11 to 33% when the reducing gas unit consumption x×Q is 1.5 to 6.0. Furthermore, in a case where a nitriding dephosphorization treatment as in the above-described case is performed after the reduction treatment, a high phosphorus removal ratio is obtained when the reduction ratio $R_{Fe}$ of iron oxide is 11 to 33%.

Next, to verify the method of the present invention, the reduction treatment was first carried out by holding a carbon monoxide (CO) gas whose flow rate was adjusted in iron ore at various temperatures (200 to 1400° C.) for 30 minutes so that the reducing gas unit consumption x×Q was 5, and then a treatment for nitriding dephosphorization was carried out at a temperature of 1000° C. under an atmosphere in which a ratio of the CO gas flow rate to a $CO_2$ gas flow rate was 2 and $N_2$ 80 vol % (nitrogen partial pressure 0.8 atm).

Figure 10:
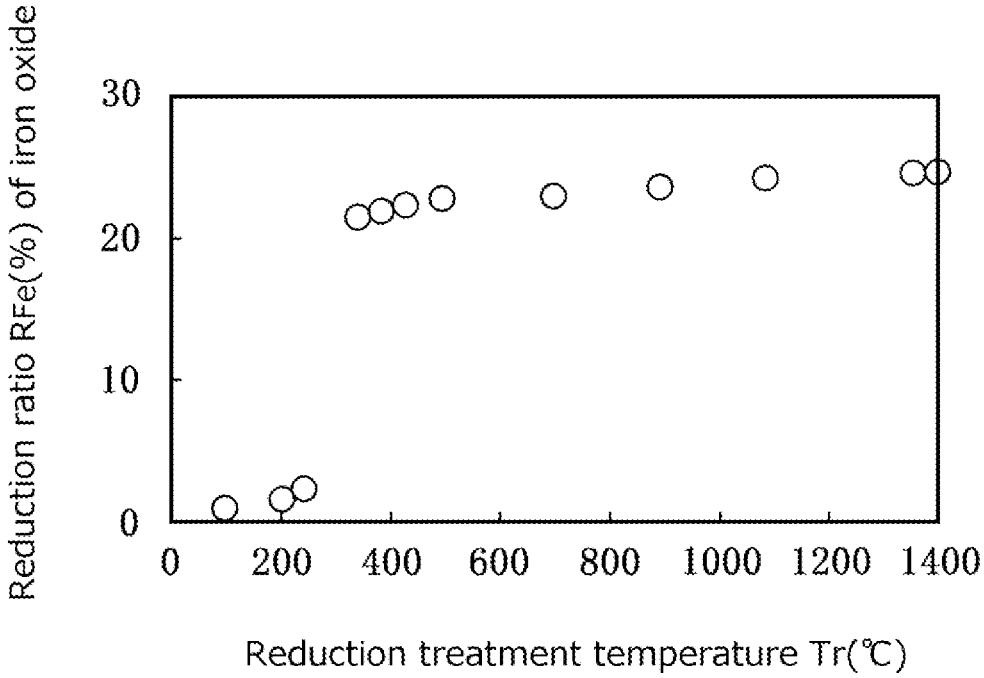
FIG. 10 is a diagram showing a relationship between a reduction treatment temperature Tr and the reduction ratio $R_{Fe}$ of iron oxide.
Figure 11:
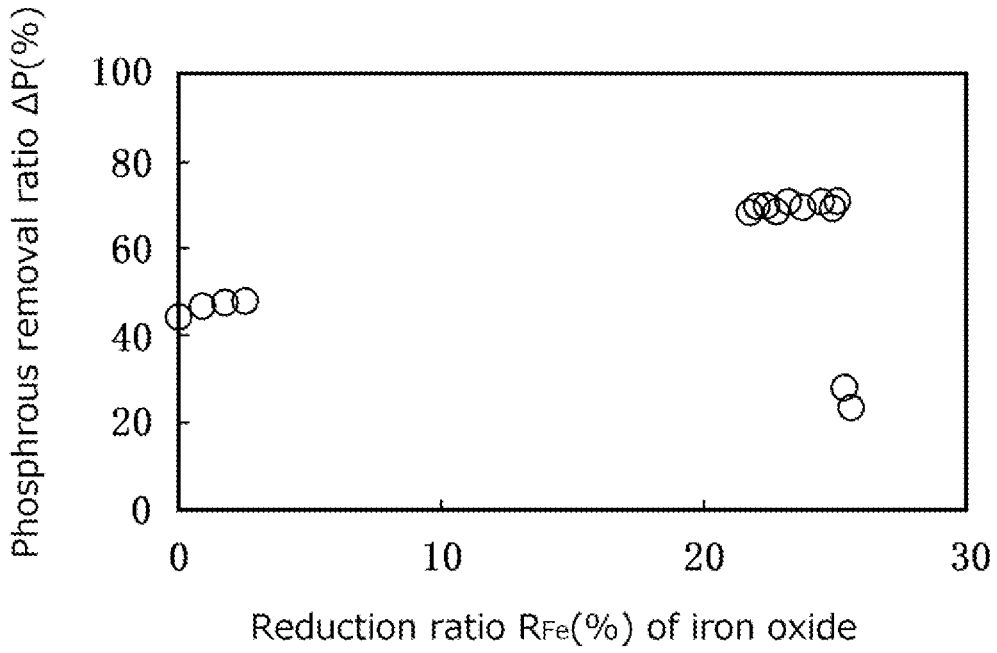
FIG. 11 is a diagram showing a relation between the reduction ratio $R_{Fe}$ of iron oxide and the phosphorus removal ratio ΔP.

FIGS. 10 and 11 show a relation between the reduction ratio $R_{Fe}$, Of iron oxide and the reduction treatment temperature Tr and a relation between the phosphorus removal ratio ΔP and the reduction ratio $R_{Fe}$ of iron oxide, respectively, which are obtained from a result of an analysis before and after a nitriding dephosphorization treatment. FIG. 10 also shows a result in a case where the reduction treatment is not performed (the reduction ratio of iron oxide is 0%). As is clear from FIG. 10, the reduction ratio $R_{Fe}$ of iron oxide is high when the reduction treatment temperature Tr is not lower than 300° C. Furthermore, as is clear from FIG. 11, except when the reduction ratio $R_{Fe}$ of iron oxide is about 26% and the phosphorus removal ratio ΔP is low, when the reduction treatment is performed, the phosphorus removal ratio ΔP is increased as compared with the case where the reduction treatment is not performed. The phosphorus removal ratio is high particularly when the reduction ratio $R_{Fe}$ of iron oxide is 10 to 26%. Conceivably, the reason why the reduction ratio $R_{Fe}$ of iron oxide is low when the reduction treatment temperature Tr is lower than 300° C. is that $Fe_2O_3$ was stable at lower than 300° C., and thus a reduction using carbon monoxide did not progress. Conceivably, as a result thereof, $Fe_2O_3$ remained after the reduction treatment at lower than 300° C., and thus the reaction (a) was suppressed until the reaction (e) progressed, resulting in lowering the phosphorus removal ratio. Furthermore, there may be a case where the phosphorus removal ratio is low when the reduction ratio $R_{Fe}$ of iron oxide is about 26%. Since this corresponds to a case where the reduction treatment temperature Tr is 1350° C. or 1400° C., conceivably, the reason for the low phosphorus removal ratio is that iron ore was in a semi-molten or molten state, and as a result of aggregation of a sample, gaps and pores between iron ore particles disappeared to significantly reduce an interfacial area for contacting gas.

A small-scale experiment was performed to confirm whether or not phosphorus is removed through nitriding when the nitriding dephosphorization treatment is carried out after a reduction treatment using the solid reducing agent. In this experiment, reagent carbon was also mixed into iron ore, and the iron ore mixed with the reagent carbon was subjected to a reduction treatment in which heating to a predetermined temperature (Tr=200 to 1400° C.) was performed and then to a nitriding dephosphorization treatment as in the case of using a reducing gas.

Figure 12:
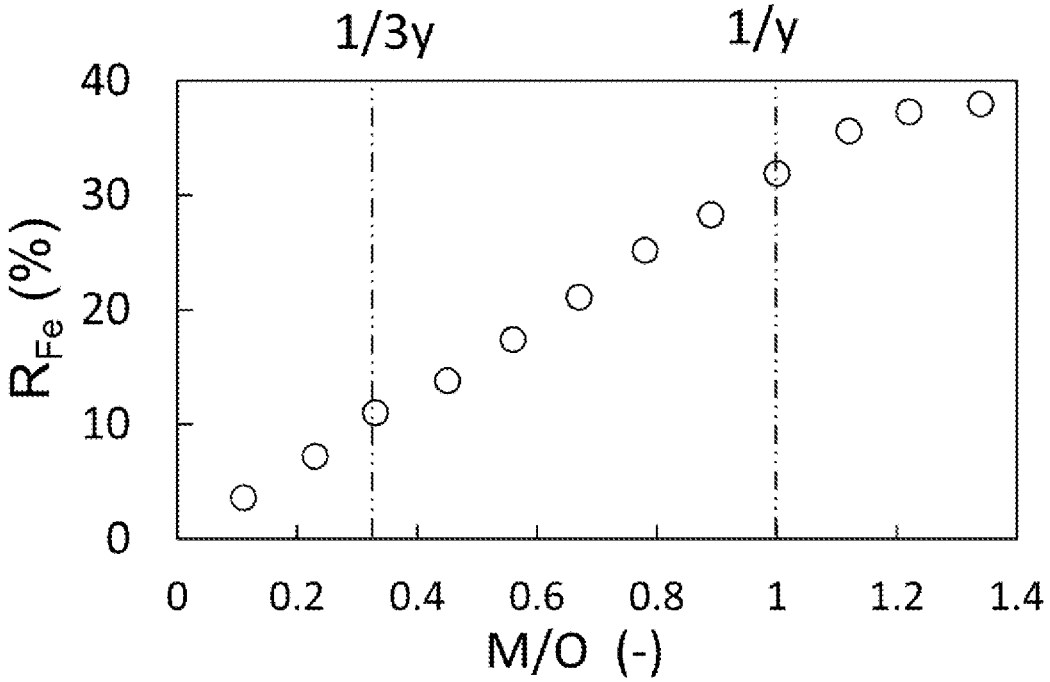
FIG. 12 is a graph showing a relation between the reduction ratio $R_{Fe}$ of iron oxide in iron ore and a reducing agent ratio M/O on an amount-of-substance basis, which is obtained from a result of an analysis before and after a treatment when a reducing agent ratio is changed at the reduction treatment temperature Tr=1000° C.
Figure 13:
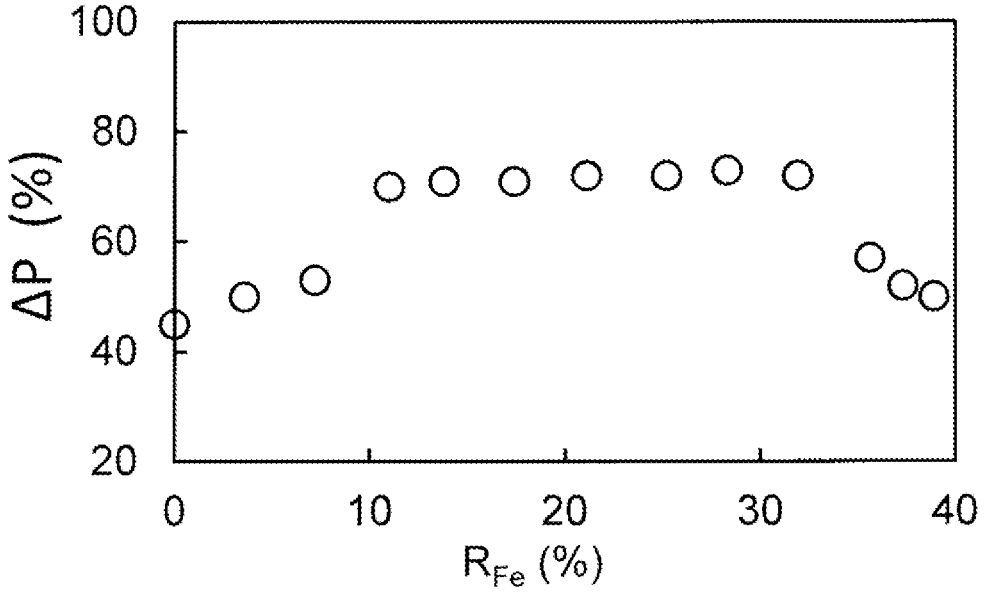
FIG. 13 is a graph showing a relation between the reduction ratio $R_{Fe}$ of iron oxide in iron ore and the phosphorus removal ratio ΔP in iron ore, which is obtained from a result of an analysis before and after a treatment when the reducing agent ratio is changed at the reduction treatment temperature Tr=1000° C.

This reduction treatment was carried out in the following manner. That is, the reagent carbon was mixed into the iron ore so that a reducing agent ratio M/O on an amount-of-substance basis was 0.11 to 1.34, and the iron ore mixed with the reagent carbon was kept at Tr=1000° C. for 30 minutes. Herein, where $W_m$, $W_{Fe2O3}$, and $W_{Mn2O3}$ denote masses (kg) of a solid reducing agent M and $Fe_2O_3$ and $Mn_2O_3$ in a phosphorus-containing substance, respectively, and $M_M$, $M_{Fe}O_3$, and $M_{Mn2O3}$ denote molar masses (kg/mol) of the solid reducing agent M and $Fe_2O_3$ and $Mn_2O_3$ in the phosphorus-containing substance, respectively, the reducing agent ratio M/O on an amount-of-substance basis is expressed as $(W_M/M_M)/\{(W_{Fe2O3}/M_{Fe2O3})+(W_{Mn2O3}/M_{Mn2O3})\}$. After that, the nitriding dephosphorization treatment was carried out at the treatment temperature $T_{DP}$=1000° C. under an atmosphere in which a ratio of a CO gas flow rate to a $CO_2$ gas flow rate was about 2.0 and $N_2$=80 vol % (nitrogen partial pressure $P_{N2}$ 0.80 atm). FIGS. 12 and 13 show a relation between the reduction ratio $R_{Fe}$ (%) of iron oxide and the reducing agent ratio M/O on an amount-of-substance basis and a relation between the phosphorus removal ratio ΔP (%) and the reduction ratio $R_{Fe}$ (%) of iron oxide, respectively, which are obtained from a result of an analysis before and after the treatment. Here, the reduction ratio $R_{Fe}$ (%) of iron oxide refers to a ratio of an amount of reduced oxygen to total oxygen in iron oxide. FIG. 13 also shows a result in a case where the reagent carbon is not used (the reduction ratio of iron oxide is 0%). As is clear from FIG. 12, the reduction ratio $R_{Fe}$ of iron oxide increases with increasing reducing agent ratio M/O on an amount-of-substance basis. Meanwhile, as is clear from FIG. 13, when the reduction treatment is performed, the phosphorus removal ratio ΔP is increased as compared with the case where the reduction treatment is not performed. Particularly when the reduction ratio $R_{Fe}$ of iron oxide is 11 to 33%, a high phosphorus removal ratio is obtained. Conceivably, the reason why the phosphorus removal ratio is low when the reduction ratio of iron oxide is lower than 11% is that $Fe_2O_3$ remained after the reduction treatment, and thus the reaction (a) was suppressed until the reaction (e) finished progressing. Conceivably, when the reduction ratio of iron oxide was larger than 33%, a part of the iron oxide was reduced to metallic iron, which then absorbed vaporized phosphorus, resulting in lowering the phosphorus removal ratio ΔP.

Further experiments were carried out for different particle sizes by applying the above-described nitriding dephosphorization treatment to manganese ore and steelmaking slag. It was then confirmed that a high phosphorus removal ratio can be obtained in a nitrogen partial pressure range of "more than 0.15 atm and less than 0.95 atm" and a temperature range of "not lower than 750° C. and not higher than a melting point (° C.)×0.95" under all conditions. It was confirmed that a high phosphorus removal ratio can be obtained particularly in a case where manganese ore or steelmaking slag is subjected to the reduction treatment with the reducing gas unit consumption x×Q of "1.5 to 6.0" or the reducing agent ratio M/O on an amount-of-substance basis of "0.33 to 1.0" and in a temperature range of "not lower than 300° C. and not higher than a melting point (° C.)× 0.95."

As described above, as a treatment of removing phosphorus in a phosphorus-containing substance through nitriding, it is required that nitrogen be suppled at a high temperature and a low oxygen partial pressure as preset conditions. As equipment used for the treatment, any type of equipment capable of heating-up and atmosphere adjustment, such as an electric furnace, a rotary hearth furnace, a kiln furnace, a fluidized bed heating furnace, and a sintering machine, can be used with no problem. Also, as a method for decreasing an oxygen partial pressure, any of the following methods may be used as long as a predetermined oxygen partial pressure can be obtained:

(a) Bringing a solid reducing agent into contact with a nitrogen gas at a high temperature, (b) Mixing a reducing gas such as any of carbon monoxide, hydrogen, and hydrocarbon into a nitrogen gas, (c) Introducing a nitrogen gas into a solid electrolyte to a voltage has been applied so as to remove oxygen.

In a case where a reduction treatment is performed before a nitriding dephosphorization treatment, however, it is required that the treatment be performed at a high temperature. Further, equipment used for the treatment may include any type of equipment capable of heating-up, such as a high-frequency heating furnace, an electric furnace, a rotary hearth furnace, a kiln furnace, a fluidized bed heating furnace, and a sintering machine. As a reducing gas, for example, types of gas such as carbon monoxide (CO), hydrocarbon ($C_mH_n$), and hydrogen ($H_2$) are desirable and effective from the viewpoint of decreasing treatment cost, but any type of gas may be used. A value of x noted above varies depending on a type of the reducing gas. When CO is used as the reducing gas, x=1 as described above, and also when $H_2$ is used as the reducing gas, the number of oxygen atoms required for $H_2$ to form $H_2O$ is one. Furthermore, when $C_mH_n$ is used as the reducing gas, x denotes the number of oxygen atoms required for a C atom to form $CO_2$ or for an H atom to form $H_2O$, and x=2 m+0.5 n is established. It is also effective that the reducing gas is used by being circulated during the reduction treatment so as to increase reaction efficiency. A solid reducing agent may be any substance containing an element stable as an oxide, such as a single element of Ca, Mg, Al, Ti, Si, or C. Furthermore, the solid reducing agent may be used in a granulated state of being mixed with a phosphorus-containing substance.

According to the method of the present invention, iron ore that has been subjected to a reduction treatment and then to a nitriding dephosphorization treatment can be used as powder ore to obtain a low phosphorus-containing sintered ore by use of a downward suction type Dwight-Lloyd sintering machine. By blending this sintered ore in a blast furnace, low-phosphorus molten pig iron can be manufactured. This makes it possible to reduce an amount of a refining agent used for a molten pig iron pretreatment and to achieve a reduction in treatment time to maintain a high molten pig iron temperature, thus contributing to large-volume use of a cold iron source, and is, therefore, effective in terms of energy saving and a reduction in environmental load. Furthermore, according to the method of the present invention, manganese ore that had been subjected to a reduction treatment and then to a nitriding dephosphorization treatment was charged as a manganese source during converter refining to manufacture low-phosphorus and high-manganese steel. In this method, low-phosphorus and high-manganese steel could be economically manufactured without the need to use an expensive manganese alloy or to perform a dephosphorization treatment in a subsequent treatment. Without being limited the above-described example, the method of the present invention is applicable to a preliminary dephosphorization treatment of iron and steel slag to be recycled, an auxiliary raw material to be charged in a preliminary treatment, or the like.

EXAMPLES

Example 1

Into a rotary hearth furnace having a scale of 5 ton/hr, 2 t or 4 t of iron ore was charged, and a reduction treatment thereof was performed for one or two hours by adjusting respective amounts of fuel and oxygen to be supplied to a heating burner and supplying a carbon monoxide gas into the furnace. Then, a nitriding dephosphorization treatment was carried out for 30 minutes, in which the respective amounts of fuel and oxygen and an amount of a nitrogen gas were adjusted to perform adjustment so that a treatment temperature was 1000° C., a $CO/CO_2$ ratio was 2.02 to 2.05, and a nitrogen partial pressure was 0.8 atm. A temperature measurement and a gas composition analysis were performed at a location of the charged sample after a lapse of 15 minutes. Respective concentrations of carbon monoxide (CO) and carbon dioxide ($CO_2$) in the gas were measured using an infrared gas analyzer, and a residual component of the gas was treated as the nitrogen gas. Further, an oxygen partial pressure was calculated from the $CO/CO_2$ ratio determined from the respective concentrations of CO and $CO_2$ based on reactions (h) to (j) expressed by formulae below, where $\Delta G°$ is a standard Gibbs free energy change of formation; T is a reaction temperature (K); K is an equilibrium constant (-); R is a gas constant (cal/(mol·K)); $P_{CO}$ is a partial pressure of carbon monoxide (atm); $P_{CO2}$ is a partial pressure of carbon dioxide (atm); and $P_{O2}$ is a partial pressure of oxygen (atm).

Furthermore, respective compositions of iron ore and manganese ore used are as shown in Table 1 above.

[Chemical Formula 8]

$$2CO_2(g) = 2CO(g) + O_2(g) \quad \text{(h)}$$

$$\Delta G° = 134{,}300 - 40.74 \times T(\text{cal/mol}) \quad \text{(i)}$$

$$K = \exp\left(-\frac{\Delta G°}{RT}\right) = \left(\frac{P_{CO}}{P_{CO_2}}\right)^2 \cdot P_{O_2} \quad \text{(j)}$$

Regarding an operation in which the reducing gas unit consumption x×Q was made to vary, Tables 2 to 3 show treatment conditions and results thereof where the reduction treatment temperature Tr 1000° C., an amount of iron ore was 2 t, and a reduction treatment time was one or two hours, and Tables 4 to 5 show treatment conditions and results thereof where an amount of iron ore was 4 t and a reduction treatment time was one or two hours.

TABLE 2

| | Iron ore amount t | Reduction treatment: Temp. ° C. | Flow rate of reducing gas Nm³/min | Reducing gas unit consumption Nm³/kg | Reduction ratio of iron oxide % | Nitriding treatment: Temp. ° C. | Gas composition: CO vol % | $CO_2$ vol % | $N_2$ vol % | CO/$CO_2$ | Oxygen partial pressure: $P_{O2}$ atm | $\log P_{O2}$ atm | Phosphorus removal rate % | Outer appearance after treatment |
|---|---|---|---|---|---|---|---|---|---|---|---|---|---|---|
| Inventive Example 1 | 2.0 | 1000 | 50 | 1.50 | 13.0 | 1000 | 13.38 | 6.62 | 80 | 2.02 | 1.72E−15 | −14.76 | 70 | Granular |
| Inventive Example 2 | 2.0 | 1000 | 75 | 2.25 | 13.6 | 1000 | 13.40 | 6.60 | 80 | 2.03 | 1.71E−15 | −14.77 | 70 | Granular |
| Inventive Example 3 | 2.0 | 1000 | 100 | 3.00 | 17.6 | 1000 | 13.43 | 6.57 | 80 | 2.04 | 1.68E−15 | −14.77 | 70 | Granular |
| Inventive Example 4 | 2.0 | 1000 | 150 | 4.50 | 24.9 | 1000 | 13.43 | 6.57 | 80 | 2.05 | 1.68E−15 | −14.78 | 71 | Granular |
| Inventive Example 5 | 2.0 | 1000 | 200 | 6.00 | 32.6 | 1000 | 13.40 | 6.60 | 80 | 2.03 | 1.70E−15 | −14.77 | 72 | Granular |
| Comparative Example 1 | 2.0 | 1000 | 10 | 0.30 | 2.4 | 1000 | 13.45 | 6.55 | 80 | 2.05 | 1.67E−15 | −14.78 | 45 | Granular |
| Comparative Example 2 | 2.0 | 1000 | 25 | 0.75 | 6.1 | 1000 | 13.38 | 6.62 | 80 | 2.02 | 1.72E−15 | −14.77 | 48 | Granular |
| Comparative Example 3 | 2.0 | 1000 | 250 | 7.50 | 38.3 | 1000 | 13.38 | 6.62 | 80 | 2.02 | 1.72E−15 | −14.77 | 50 | Granular |
| Comparative Example 4 | 2.0 | 1000 | 300 | 9.00 | 46.3 | 1000 | 13.44 | 6.56 | 80 | 2.05 | 1.67E−15 | −14.78 | 50 | Granular |

TABLE 3

| | Iron ore amount t | Reduction treatment: Temp. ° C. | Flow rate of reducing gas Nm³/min | Reducing gas unit consumption Nm³/kg | Reduction ratio of iron oxide % | Nitriding treatment: Temp. ° C. | Gas composition: CO vol % | $CO_2$ vol % | $N_2$ vol % | CO/$CO_2$ | Oxygen partial pressure: $P_{O2}$ atm | $\log P_{O2}$ atm | Phosphorus removal rate % | Outer appearance after treatment |
|---|---|---|---|---|---|---|---|---|---|---|---|---|---|---|
| Inventive Example 6 | 2.0 | 1000 | 25 | 1.50 | 11.5 | 1000 | 13.41 | 6.59 | 80 | 2.04 | 1.69E−15 | −14.77 | 70 | Granular |
| Inventive Example 7 | 2.0 | 1000 | 38 | 2.25 | 13.9 | 1000 | 13.44 | 6.56 | 80 | 2.05 | 1.67E−15 | −14.78 | 71 | Granular |
| Inventive Example 8 | 2.0 | 1000 | 50 | 3.00 | 18.1 | 1000 | 13.39 | 6.61 | 80 | 2.03 | 1.71E−15 | −14.77 | 71 | Granular |
| Inventive Example 9 | 2.0 | 1000 | 75 | 4.50 | 24 9 | 1000 | 13.43 | 6.57 | 80 | 2.04 | 1.68E−15 | −14.77 | 72 | Granular |
| Inventive Example 10 | 2.0 | 1000 | 100 | 6.00 | 33.0 | 1000 | 13.41 | 6.59 | 80 | 2.04 | 1.70E−15 | −14.77 | 79 | Granular |
| Comparative Example 5 | 2.0 | 1000 | — | — | — | 1000 | 12.73 | 6.27 | 81 | 2.03 | 1.70E−15 | −14.77 | 45 | Granular |
| Comparative Example 6 | 2.0 | 1000 | 5 | 0.30 | 2.0 | 1000 | 13.39 | 6.61 | 80 | 2.03 | 1.71E−15 | −14.77 | 48 | Granular |
| Comparative Example 7 | 2.0 | 1000 | 13 | 0.75 | 4.9 | 1000 | 13.44 | 6.56 | 80 | 2.05 | 1.67E−15 | −14.78 | 49 | Granular |
| Comparative Example 8 | 2.0 | 1000 | 125 | 7.50 | 39.3 | 1000 | 13.41 | 6.59 | 80 | 2.03 | 1.70E−15 | −14.77 | 50 | Granular |
| Comparative Example 9 | 2.0 | 1000 | 150 | 9.00 | 45.1 | 1000 | 13.42 | 6.58 | 80 | 2.04 | 1.69E−15 | −14.77 | 49 | Granular |

TABLE 4

| | Iron ore amount t | Reduction treatment: Temp. ° C. | Flow rate of reducing gas Nm³/min | Reducing gas unit consumption Nm³/kg | Reduction ratio of iron oxide % | Nitriding treatment: Temp. ° C. | Gas composition: CO vol % | $CO_2$ vol % | $N_2$ vol % | $CO/CO_2$ | Oxygen partial pressure: $P_{O2}$ atm | $\log P_{O2}$ atm | Phosphorus removal rate % | Outer appearance after treatment |
|---|---|---|---|---|---|---|---|---|---|---|---|---|---|---|
| Inventive Example 11 | 4.0 | 1000 | 100 | 1.50 | 13.0 | 1000 | 13.44 | 6.56 | 80 | 2.05 | 1.67E−15 | −14.78 | 69 | Granular |
| Inventive Example 12 | 4.0 | 1000 | 150 | 2.25 | 12.9 | 1000 | 13.44 | 6.56 | 80 | 2.05 | 1.67E−15 | −14.78 | 70 | Granular |
| Inventive Example 13 | 4.0 | 1000 | 200 | 3.00 | 18.6 | 1000 | 13.40 | 6.60 | 80 | 2.03 | 1.70E−15 | −14.77 | 69 | Granular |
| Inventive Example 14 | 4.0 | 1000 | 300 | 4.50 | 23.5 | 1000 | 13.41 | 6.59 | 80 | 2.04 | 1.69E−15 | −14.77 | 71 | Granular |
| Inventive Example 15 | 4.0 | 1000 | 400 | 6.00 | 32.7 | 1000 | 13.44 | 6.56 | 80 | 2.05 | 1.67E−15 | −14.78 | 71 | Granular |
| Comparative Example 10 | 4.0 | 1000 | 20 | 0.30 | 2.5 | 1000 | 13.42 | 6.58 | 80 | 2.04 | 1.69E−15 | −14.77 | 47 | Granular |
| Comparative Example 11 | 4.0 | 1000 | 50 | 0.75 | 4.3 | 1000 | 13.40 | 6.60 | 80 | 2.03 | 1.71E−15 | −14.77 | 48 | Granular |
| Comparative Example 12 | 4.0 | 1000 | 500 | 7.50 | 39.6 | 1000 | 13.43 | 6.57 | 80 | 2.04 | 1.68E−15 | −14.77 | 50 | Granular |
| Comparative Example 13 | 4.0 | 1000 | 600 | 9.00 | 45.6 | 1000 | 13.43 | 6.57 | 80 | 2.04 | 1.68E−15 | −14.77 | 49 | Granular |

TABLE 5

| | Iron ore amount t | Reduction treatment: Temp. ° C. | Flow rate of reducing gas Nm³/min | Reducing gas unit consumption Nm³/kg | Reduction ratio of iron oxide % | Nitriding treatment: Temp. ° C. | Gas composition CO vol % |
|---|---|---|---|---|---|---|---|
| Inventive Example 16 | 4.0 | 1000 | 50 | 1.50 | 10.6 | 1000 | 13.44 |
| Inventive Example 17 | 4.0 | 1000 | 75 | 2.25 | 13.0 | 1000 | 12.76 |
| inventive Example 18 | 4.0 | 1000 | 100 | 3.00 | 18.7 | 1000 | 12.78 |
| Inventive Example 19 | 4.0 | 1000 | 150 | 4.50 | 26.3 | 1000 | 13.43 |
| Inventive Example 20 | 4.0 | 1000 | 200 | 6.00 | 32.0 | 1000 | 13.43 |
| Comparative Example 14 | 4.0 | 1000 | 10 | 0.30 | 1.7 | 1000 | 13.42 |
| Comparative Example 15 | 4.0 | 1000 | 25 | 0.75 | 4.9 | 1000 | 13.42 |
| Comparative Example 16 | 4.0 | 1000 | 250 | 7.50 | 38.6 | 1000 | 13.44 |
| Comparative Example 17 | 4.0 | 1000 | 300 | 9.00 | 45.0 | 1000 | 13.39 |

| | Nitriding treatment: Gas composition: $CO_2$ vol % | $N_2$ vol % | $CO/CO_2$ | Oxygen partial pressure: $P_{O2}$ atm | $\log P_{O2}$ atm | Phosphorus removal rate % | Outer appearance after treatment |
|---|---|---|---|---|---|---|---|
| Inventive Example 16 | 6.56 | 80 | 2.05 | 1.67E−15 | −14.78 | 69 | Granular |
| Inventive Example 17 | 6.24 | 81 | 2.05 | 1.68E−15 | −14.78 | 70 | Granular |
| inventive Example 18 | 6.22 | 81 | 2.05 | 1.67E−15 | −14.78 | 70 | Granular |
| Inventive Example 19 | 6.57 | 80 | 2.04 | 1.68E−15 | −14.77 | 71 | Granular |
| Inventive Example 20 | 6.57 | 80 | 2.05 | 1.68E−15 | −14.78 | 71 | Granular |

TABLE 5-continued

| | | | | | | | |
|---|---|---|---|---|---|---|---|
| Comparative Example 14 | 6.58 | 80 | 2.04 | 1.68E−15 | −14.77 | 47 | Granular |
| Comparative Example 15 | 6.58 | 80 | 2.04 | 1.69E−15 | −14.77 | 48 | Granular |
| Comparative Example 16 | 6.56 | 80 | 2.05 | 1.67E−15 | −14.78 | 49 | Granular |
| Comparative Example 17 | 6.61 | 80 | 2.03 | 1.71E−15 | −44.77 | 48 | Granular |

In inventive Examples 1 to 20 of the present invention shown in Tables 2 to 5 in which the reduction treatment was performed first, a phosphorus removal ratio is improved by performing the reduction treatment as compared with Comparative Example 1 of the present invention in which the reduction treatment was not performed, with any value of the reducing gas unit consumption x×Q, Furthermore, in Inventive Examples 1 to 20 of the present invention in which the reducing gas unit consumption x×Q is 1.5 to 6.0, as compared with Comparative Examples 2 to 17, the phosphorus removal ratio is as high as about 70%. Conceivably, the reason why an increase in phosphorus removal ratio is small when the reducing gas unit consumption x×Q is less than 1.5 is that $Fe_2O_3$ still remained after the reduction treatment, and thus the above-described reaction (a) was suppressed until the above-described reaction (e) progressed. Conceivably, the reason why the phosphorus removal ratio is low when the reducing gas unit consumption x×Q is larger than 6.0 is that a metallic iron resulting from progress of the above-described reaction (b) absorbed vaporized phosphorus, resulting in lowering the phosphorus removal ratio.

Furthermore, regarding an operation in which the reducing gas unit consumption x×Q was made to vary, Tables 6 to 7 show, along with results thereof, treatment conditions that the reduction treatment temperature Tr=1000° C., an amount of iron ore was 2 t, and a flow rate of a reducing gas was 25 L/min or 100 L/min., and Tables 8 to 9 show, along with results thereof, treatment conditions that an amount of iron ore was 4 t and a flow rate of the reducing gas was 25 L/min or 100 L/min. In inventive Examples 21 to 40 of the present invention shown in Tables 6 to 9, for any value of the reduction treatment temperature Tr, as compared with Comparative Example 1 in which the reduction treatment was not performed, a phosphorus removal ratio is improved by performing the reduction treatment. Furthermore, in Inventive Examples 21 to 40 of the present invention in which the reducing gas unit consumption x×Q is 1.5 to 6.0, as compared with Comparative Examples 18 to 33, the phosphorus removal ratio is as high as about 70%. Conceivably, the reason why an increase in phosphorus removal ratio is small when the reducing gas unit consumption x×Q is less than 1.5 is that $Fe_2O_3$ still remained after the reduction treatment, and thus the reaction (a) was suppressed until the reaction (e) progressed. Further, conceivably, the reason why the phosphorus removal ratio is low when the reducing gas unit consumption x×Q is larger than 6.0 is that a metallic iron resulting from progress of the reaction (b) absorbed vaporized phosphorus, resulting in lowering the phosphorus removal ratio.

TABLE 6

| | | Reduction treatment | | | | Nitriding treatment | |
|---|---|---|---|---|---|---|---|
| | Iron ore amount t | Temperature ° C. | Flow rate of reducing gas $Nm^3$/min | Reducing gas unit consumption $Nm^3$/kg | Reduction ratio of iron oxide % | Temp. ° C. | Gas composition CO vol % |
| Inventive Example 21 | 2.0 | 1000 | 25 | 1.50 | 11.7 | 1000 | 13.41 |
| Inventive Example 22 | 2.0 | 1000 | 25 | 2.25 | 13.8 | 1000 | 12.72 |
| Inventive Example 23 | 2.0 | 1000 | 25 | 3.00 | 18.5 | 1000 | 12.72 |
| Inventive Example 24 | 2.0 | 1000 | 25 | 4.50 | 26.4 | 1000 | 13.38 |
| Inventive Example 25 | 2.0 | 1000 | 25 | 6.00 | 32.9 | 1000 | 13.42 |
| Comparative Example 18 | 2.0 | 1000 | 25 | 0.30 | 2.2 | 1000 | 13.40 |
| Comparative Example 19 | 2.0 | 1000 | 25 | 0.75 | 5.2 | 1000 | 13.44 |
| Comparative Example 20 | 2.0 | 1000 | 25 | 7.50 | 39.5 | 1000 | 13.44 |
| Comparative Example 21 | 2.0 | 1000 | 25 | 9.00 | 45.0 | 1000 | 13.43 |

| | Nitriding treatment | | | | | | |
|---|---|---|---|---|---|---|---|
| | Gas composition | | | Oxygen partial pressure | | Phosphorus removal | Outer |
| | $CO_2$ vol % | $N_2$ vol % | $CO/CO_2$ | $P_{O2}$ atm | $\log P_{O2}$ atm | rate % | appearance after treatment |
| Inventive Example 21 | 6.59 | 80 | 2.03 | 1.70E−15 | −14.77 | 71 | Granular |

TABLE 6-continued

| | | | | | | | |
|---|---|---|---|---|---|---|---|
| Inventive Example 22 | 6.28 | 81 | 2.02 | 1.71E−15 | −14.77 | 71 | Granular |
| Inventive Example 23 | 6.28 | 81 | 2.02 | 1.71E−15 | −14.77 | 71 | Granular |
| Inventive Example 24 | 6.62 | 80 | 2.02 | 1.72E−15 | −14.77 | 72 | Granular |
| Inventive Example 25 | 6.58 | 80 | 2.04 | 1.69E−15 | −14.77 | 72 | Granular |
| Comparative Example 18 | 6.60 | 80 | 2.03 | 1.70E−15 | −14.77 | 45 | Granular |
| Comparative Example 19 | 6.56 | 80 | 2.05 | 1.68E−15 | −14.78 | 48 | Granular |
| Comparative Example 20 | 6.56 | 80 | 2.05 | 1.67E−15 | −14.78 | 49 | Granular |
| Comparative Example 21 | 6.57 | 80 | 2.04 | 1.68E−15 | −14.77 | 51 | Granular |

TABLE 7

| | | Reduction treatment | | | | Nitriding treatment | |
|---|---|---|---|---|---|---|---|
| | Iron ore amount t | Temp. ° C. | Flow rate of reducing gas $Nm^3$/min | Reducing gas unit consumption $Nm^3$/kg | Reduction ratio of iron oxide % | Temp. ° C. | Gas composition CO vol % |
| Inventive Example 26 | 2.0 | 1000 | 100 | 1.50 | 11.5 | 1000 | 13.42 |
| Inventive Example 27 | 2.0 | 1000 | 100 | 2.25 | 13.9 | 1000 | 1.3.40 |
| Inventive Example 28 | 2.0 | 1000 | 100 | 3.00 | 18.9 | 1000 | 13.42 |
| Inventive Example 29 | 2.0 | 1000 | 100 | 4.50 | 26.1 | 1000 | 13,44 |
| Inventive Example 30 | 2.0 | 1000 | 100 | 6.00 | 33.2 | 1000 | 13.45 |
| Comparative Example 22 | 2.0 | 1000 | 100 | 0.30 | 1.5 | 1000 | 13.41 |
| Comparative Example 23 | 2.0 | 1000 | 100 | 0.75 | 4.8 | 1000 | 13.45 |
| Comparative Example 24 | 2.0 | 1000 | 100 | 7.50 | 39.2 | 1000 | 13.39 |
| Comparative Example 25 | 2.0 | 1000 | 100 | 9.00 | 44.8 | 1000 | 13.43 |

| | Nitriding treatment | | | | | | |
|---|---|---|---|---|---|---|---|
| | Gas composition | | | Oxygen partial pressure | | Phosphorus | Outer |
| | $CO_2$ vol % | $N_2$ vol % | $CO/CO_2$ | $P_{O2}$ atm | $\log P_{O2}$ atm | removal rate % | appearance after treatment |
| Inventive Example 26 | 6.58 | 80 | 2.04 | 1.69E−15 | −14.77 | 69 | Granular |
| Inventive Example 27 | 6.60 | 80 | 2.03 | 1.70E−15 | −14.77 | 71 | Granular |
| Inventive Example 28 | 6.58 | 80 | 2.04 | 1.69E−15 | −14.77 | 71 | Granular |
| Inventive Example 29 | 6.56 | 80 | 2.05 | 1.67E−15 | −14.78 | 72 | Granular |
| Inventive Example 30 | 6.55 | 80 | 2.05 | 1.67E−15 | −14.78 | 72 | Granular |
| Comparative Example 22 | 6.59 | 80 | 2.04 | 1.69E−15 | −14.77 | 45 | Granular |
| Comparative Example 23 | 6.55 | 80 | 2.05 | 1.67E−15 | −14.78 | 48 | Granular |
| Comparative Example 24 | 6.61 | 80 | 2.03 | 1.71E−15 | −14.77 | 49 | Granular |
| Comparative Example 25 | 6.57 | 80 | 2.05 | 1.68E−15 | −14.78 | 51 | Granular |

TABLE 8

| | | Reduction treatment | | | | Nitriding treatment | |
|---|---|---|---|---|---|---|---|
| | Iron ore amount t | Temp. ° C. | Flow rate of reducing gas $Nm^3$/min | Reducing gas unit consumption $Nm^3$/kg | Reduction ratio of iron oxide % | Temp. ° C. | Gas composition CO vol % |
| Inventive Example 31 | 4.0 | 1000 | 25 | 1.50 | 10.5 | 1000 | 13.42 |
| Inventive Example 32 | 4.0 | 1000 | 25 | 2.25 | 13.9 | 1000 | 13.45 |
| Inventive Example 33 | 4.0 | 1000 | 25 | 3.00 | 18.6 | 1000 | 13.43 |
| Inventive Example 34 | 4.0 | 1000 | 25 | 4.50 | 25.7 | 1000 | 13.40 |
| Inventive Example 35 | 4.0 | 1000 | 25 | 6.00 | 31.7 | 1000 | 13.40 |
| Comparative Example 26 | 4.0 | 1000 | 25 | 0.30 | 1.9 | 1000 | 13.45 |
| Comparative Example 27 | 4.0 | 1000 | 25 | 0.75 | 4.4 | 1000 | 13.41 |
| Comparative Example 28 | 4.0 | 1000 | 25 | 7.50 | 38.1 | 1000 | 13.40 |
| Comparative Example 29 | 4.0 | 1000 | 25 | 9.00 | 44.4 | 1000 | 13.41 |

| | Nitriding treatment | | | | | | |
|---|---|---|---|---|---|---|---|
| | Gas composition | | | Oxygen partial pressure | | Phosphorus | Outer |
| | $CO_2$ vol % | $N_2$ vol % | $CO/CO_2$ | $P_{O2}$ atm | $\log P_{O2}$ atm | removal rate % | appearance after treatment |
| Inventive Example 31 | 6.58 | 80 | 2.04 | 1.69E−15 | −14.77 | 69 | Granular |
| Inventive Example 32 | 6.55 | 80 | 2.05 | 1.67E−15 | −14.78 | 70 | Granular |
| Inventive Example 33 | 6.57 | 80 | 2.04 | 1.68E−15 | −14.77 | 70 | Granular |
| Inventive Example 34 | 6.60 | 80 | 2.03 | 1.70E−15 | −14.77 | 71 | Granular |
| Inventive Example 35 | 6.60 | 80 | 2.03 | 1.71E−15 | −14.77 | 70 | Granular |
| Comparative Example 26 | 6.55 | 80 | 2.05 | 1.67E−15 | −14.78 | 47 | Granular |
| Comparative Example 27 | 6.59 | 80 | 2.03 | 1.70E−15 | −14.77 | 48 | Granular |
| Comparative Example 28 | 6.60 | 80 | 2.03 | 1.7 IE−15 | −14.77 | 48 | Granular |
| Comparative Example 29 | 6.59 | 80 | 2.04 | 1.69E−15 | −14.77 | 48 | Granular |

TABLE 9

| | | Reduction treatment | | | | Nitriding treatment | |
|---|---|---|---|---|---|---|---|
| | Iron ore amount t | Temp. ° C. | Flow rate of reducing gas $Nm^3$/min | Reducing gas unit consumption $Nm^3$/kg | Reduction ratio of iron oxide % | Temp. ° C. | Gas composition CO vol % |
| Inventive Example 36 | 4.0 | 1000 | 100 | 1.50 | 11.4 | 1000 | 13.38 |
| Inventive Example 37 | 4.0 | 1000 | 100 | 2.25 | 13.2 | 1000 | 12.75 |
| Inventive Example 38 | 4.0 | 1000 | 100 | 3.00 | 17.4 | 1000 | 12.75 |
| Inventive Example 39 | 4.0 | 1000 | 100 | 4.50 | 26.3 | 1000 | 13.43 |
| Inventive Example 40 | 4.0 | 1000 | 100 | 6.00 | 33.0 | 1000 | 13.40 |
| Comparative Example 30 | 4.0 | 1000 | 100 | 0.30 | 1.9 | 1000 | 13.43 |
| Comparative Example 31 | 4.0 | 1000 | 100 | 0.75 | 4.6 | 1000 | 13.40 |

TABLE 9-continued

| | | | | | | | |
|---|---|---|---|---|---|---|---|
| Comparative Example 32 | 4.0 | 1000 | 100 | 7.50 | 37.5 | 1000 | 13.39 |
| Comparative Example 33 | 4.0 | 1000 | 100 | 9.00 | 44.9 | 1000 | 13.38 |

| | Nitriding treatment | | | | | | |
|---|---|---|---|---|---|---|---|
| | Gas composition | | | Oxygen partial pressure | | Phosphorus | Outer |
| | $CO_2$ vol % | $N_2$ vol % | $CO/CO_2$ | $P_{O2}$ atm | $\log P_{O2}$ atm | removal rate % | appearance after treatment |
| Inventive Example 36 | 6.62 | 80 | 2.02 | 1.72E−15 | −14.77 | 69 | Granular |
| Inventive Example 37 | 6.25 | 81 | 2.04 | 1.69E−15 | −14.77 | 70 | Granular |
| Inventive Example 38 | 6.25 | 81 | 2.04 | 1.69E−15 | −14.77 | 71 | Granular |
| Inventive Example 39 | 6.57 | 80 | 2.04 | 1.68E−15 | −14.77 | 71 | Granular |
| Inventive Example 40 | 6.60 | 80 | 2.03 | 1.70E−15 | −14.77 | 70 | Granular |
| Comparative Example 30 | 6.57 | 80 | 2.04 | 1.68E−15 | −14.77 | 47 | Granular |
| Comparative Example 31 | 6.60 | 80 | 2.03 | 1.70E−15 | −14.77 | 48 | Granular |
| Comparative Example 32 | 6.61 | 80 | 2.03 | 1.71E−15 | −14.77 | 49 | Granular |
| Comparative Example 33 | 6.62 | 80 | 2.02 | 1.72E−15 | −14.76 | 48 | Granular |

Regarding an operation in which the reduction treatment temperature Tr was made to vary, Tables 10 to 11 show treatment conditions and results thereof where the reducing gas unit consumption x×Q was 3.0 or 5.0, an amount of iron ore was 2 t and a reduction treatment time was one hour. In Inventive Examples 41 to 52 of the present invention shown in Tables 10 to 11, for any value of the reducing gas unit consumption x×Q, as compared with Comparative Example 1 shown in Table 2, the phosphorus removal ratio ΔP is improved by the reduction treatment under a condition that the reduction treatment temperature Tr is not higher than 1300° C. The phosphorus removal ratio ΔP is high particularly in Inventive Examples 41 to 52 of the present invention in which the reduction treatment was performed at 300 to 1300° C. Furthermore, conceivably, the reason why an increase in the phosphorus removal ratio ΔP is small in Comparative Examples 34 to 35 and Comparative Examples 38 to 39 in which the reduction treatment was performed at a temperature lower than 300° C. is that $Fe_2O_3$ was stable at lower than 300° C., and thus a reduction using carbon monoxide did not progress. As a result, $Fe_2O_3$ remained after the reduction treatment at lower than 300° C., and thus the above-described reaction (a) was suppressed until the above-described reaction (e) progressed, resulting in lowering the phosphorus removal ratio. Conceivably, the reason why the phosphorus removal ratio is low in Comparative Examples 36 to 37 and Comparative Examples 40 to 41 in which the reduction treatment was performed at a temperature higher than 1300° C. is that a melting point of iron ore used this time was 1370° C., so that the iron ore was in a semi-molten or molten state at the reduction treatment temperature Tr of 1350 or 1400° C. and as a result of aggregation of a sample, gaps and pores between iron ore particles disappeared to significantly reduce an interfacial area for contacting gas. A melting point $T_m$ used in this example was measured based on the first method described above in paragraph.

TABLE 10

| | | Reduction treatment | | | | Nitriding treatment | |
|---|---|---|---|---|---|---|---|
| | Iron ore amount t | Temp. ° C. | Flow rate of reducing gas $Nm^3$/min | Reducing gas unit consumption $Nm^3$/kg | Reduction ratio of iron oxide % | Temp. ° C. | Gas composition CO vol % |
| Inventive Example 41 | 2.0 | 300 | 50 | 3.00 | 22.0 | 1000 | 13.40 |
| Inventive Example 42 | 2.0 | 500 | 50 | 3.00 | 23.6 | 1000 | 13.38 |
| Inventive Example 43 | 2.0 | 700 | 50 | 3.00 | 24.2 | 1000 | 13.38 |
| Inventive Example 44 | 2.0 | 900 | 50 | 3.00 | 25.2 | 1000 | 13.42 |
| Inventive Example 45 | 2.0 | 1100 | 50 | 3.00 | 25.5 | 1000 | 13.40 |
| Inventive Example 46 | 2.0 | 1300 | 50 | 3.00 | 25.6 | 1000 | 13.42 |

TABLE 10-continued

| | | | | | | | |
|---|---|---|---|---|---|---|---|
| Comparative Example 34 | 2.0 | 200 | 50 | 3.00 | 2.1 | 1000 | 13.40 |
| Comparative Example 35 | 2.0 | 250 | 50 | 3.00 | 3.0 | 1000 | 13.40 |
| Comparative Example 36 | 2.0 | 1350 | 50 | 3.00 | 25.8 | 1000 | 13.44 |
| Comparative Example 37 | 2.0 | 1400 | 50 | 3.00 | 26.1 | 1000 | 12.77 |

| | Nitriding treatment | | | | | | |
|---|---|---|---|---|---|---|---|
| | Gas composition | | | Oxygen partial pressure | | Phosphorus | Outer |
| | $CO_2$ vol % | $N_2$ vol % | $CO/CO_2$ | $P_{O2}$ atm | $\log P_{O2}$ atm | removal rate % | appearance after treatment |
| Inventive Example 41 | 6.60 | 80 | 2.03 | 1.70E−15 | −14.77 | 70 | Granular |
| Inventive Example 42 | 6.62 | 80 | 2.02 | 1.72E−15 | −14.76 | 70 | Granular |
| Inventive Example 43 | 6.62 | 80 | 2.02 | 1.72E−15 | −14.77 | 71 | Granular |
| Inventive Example 44 | 6.58 | 80 | 2.04 | 1.69E−15 | −14.77 | 71 | Granular |
| Inventive Example 45 | 6.60 | 80 | 2.03 | 1.70E−15 | −14.77 | 70 | Granular |
| Inventive Example 46 | 6.58 | 80 | 2.04 | 1.69E−15 | −14.77 | 72 | Granular |
| Comparative Example 34 | 6.60 | 80 | 2.03 | 1.70E−15 | −14.77 | 48 | Granular |
| Comparative Example 35 | 6.60 | 80 | 2.03 | 1.70E−15 | −14.77 | 50 | Granular |
| Comparative Example 36 | 6.56 | 80 | 2.05 | 1.68E−15 | −14.78 | 25 | Molten state |
| Comparative Example 37 | 6.23 | 81 | 2.05 | 1.67E−15 | −14.78 | 20 | Molten state |

TABLE 11

| | | Reduction treatment | | | | Nitriding treatment | |
|---|---|---|---|---|---|---|---|
| | Iron ore amount t | Temp. ° C. | Flow rate of reducing gas $Nm^3$/min | Reducing gas unit consumption $Nm^3$/kg | Reduction ratio of iron oxide % | Temp. ° C. | Gas composition CO vol % |
| Inventive Example 47 | 2.0 | 300 | 83 | 5.00 | 23.0 | 1000 | 13.39 |
| Inventive Example 48 | 2.0 | 500 | 83 | 5.00 | 24.0 | 1000 | 13.43 |
| Inventive Example 49 | 2.0 | 700 | 83 | 5.00 | 24.6 | 1000 | 13.40 |
| Inventive Example 50 | 2.0 | 900 | 83 | 5.00 | 25.2 | 1000 | 13.39 |
| Inventive Example 51 | 2.0 | 1100 | 83 | 5.00 | 26.2 | 1000 | 13.39 |
| Inventive Example 52 | 2.0 | 1300 | 83 | 5.00 | 26.6 | 1000 | 13.39 |
| Comparative Example 38 | 2.0 | 200 | 83 | 5.00 | 2.3 | 1000 | 13.40 |
| Comparative Example 39 | 2.0 | 250 | 83 | 5.00 | 3.3 | 1000 | 13.38 |
| Comparative Example 40 | 2.0 | 1350 | 83 | 5.00 | 26.5 | 1000 | 13.43 |
| Comparative Example 41 | 2.0 | 1400 | 83 | 5.00 | 26.6 | 1000 | 13.44 |

TABLE 11-continued

| | Nitriding treatment | | | | | | |
|---|---|---|---|---|---|---|---|
| | Gas composition | | | Oxygen partial pressure | | Phosphorus | Outer |
| | $CO_2$ vol % | $N_2$ vol % | $CO/CO_2$ | $P_{O2}$ atm | $\log P_{O2}$ atm | removal rate % | appearance after treatment |
| Inventive Example 47 | 6.61 | 80 | 2.03 | 1.71E−15 | −14.77 | 70 | Granular |
| Inventive Example 48 | 6.57 | 80 | 2.04 | 1.68E−15 | −14.77 | 71 | Granular |
| Inventive Example 49 | 6.60 | 80 | 2.03 | 1.71E−15 | −14.77 | 71 | Granular |
| Inventive Example 50 | 6.61 | 80 | 2.03 | 1.71E−15 | −14.77 | 71 | Granular |
| Inventive Example 51 | 6.61 | 80 | 2.03 | 1.71E−15 | −14.77 | 72 | Granular |
| Inventive Example 52 | 6.61 | 80 | 2.03 | 1.71E−15 | −14.77 | 72 | Granular |
| Comparative Example 38 | 6.60 | 80 | 2.03 | 1.71E−15 | −14.77 | 49 | Granular |
| Comparative Example 39 | 6.62 | 80 | 2.02 | 1.72E−15 | −14.77 | 50 | Granular |
| Comparative Example 40 | 6.57 | 80 | 2.04 | 1.68E−15 | −14.77 | 24 | Molten state |
| Comparative Example 41 | 6.56 | 80 | 2.05 | 1.67E−15 | −14.78 | 21 | Molten state |

Example 2

Into a rotary hearth furnace having a scale of 5 ton/hr, 4 t of iron ore or 4 t of manganese ore were charged together with a carbonaceous material, and a reduction treatment thereof was performed for two hours by adjusting respective amounts of fuel and oxygen to be supplied to a heating burner. Then, a nitriding dephosphorization treatment was carried out for 30 minutes by adjusting the respective amounts of fuel and oxygen to be supplied to the heating burner, a ratio therebetween, and an amount of a nitrogen gas to be supplied to perform adjustment so that the treatment temperature $T_{DP}$=1000° C., a $CO/CO_D$ ratio: a range of 2.02 to 2.05, and a nitrogen partial pressure $P_{N2}$=0.80 atm. A temperature measurement and a gas composition analysis were performed at a location of the charged sample after a lapse of 15 minutes in the nitriding dephosphorization treatment.

Tables 12-1 to 12-7 show treatment conditions and results in a case of treating iron ore. Treatment No. 1 is a comparative example in which a reduction treatment was not performed. Treatments Nos. 2 to 49 show results of operations in which the reduction treatment temperature Tr was set to 300, 800, 1000, and 1300° C. and the reducing agent ratio M/O on an amount-of-substance basis to iron ore was made to vary. In Treatments Nos. 2 to 49, under any of reduction treatment conditions, as compared with Treatment No. 1 as the comparative example, the phosphorus removal ratio ΔP by a nitriding dephosphorization treatment is improved. The phosphorus removal ratio ΔP is as high as about 70% particularly under a condition that the reducing agent ratio M/O on an amount-of-substance basis is ⅓ to 1.0, Conceivably, the reason why an increase in phosphorus removal ratio is small when the reducing agent ratio M/O on an amount-of-substance basis is less than ⅓ is as follows. That is, under the conditions of this example, a carbonaceous material is used as a solid reducing agent, and thus an amount of substance y of an oxygen atom that reacts with 1 mol of the solid reducing agent is 1 mol. The reducing agent ratio M/O on an amount-of-substance basis required for the above-described reaction (e) to completely progress rightward (a reduction reaction) is expressed as ⅓$y$ ⅓. That is, conceivably, when the reducing agent ratio M/O on an amount-of-substance basis was less than ⅓, $Fe_2O_3$ remained after the reduction treatment, and thus in a subsequent nitriding dephosphorization treatment, a dephosphorization reaction of the above-described reaction (a) was suppressed until the above-described reaction (e) was completed. On the other hand, conceivably, the reason why the phosphorus removal ratio ΔP is low when the reducing agent ratio M/O on an amount-of-substance basis is larger than 1.0 is as follows. That is, the reducing agent ratio M/O on an amount-of-substance basis required for a reaction (k) expressed by Chemical Formula 12 below to completely progress rightward (a reduction reaction) is expressed as 1/y=1. That is, when the reducing agent ratio M/O on an amount-of-substance basis is more than 1.0, the above-described reaction (b) progresses rightward (a reduction reaction) to cause metallic iron to be formed, Therefore, it was considered that phosphorus was absorbed by the metallic iron, resulting in lowering the phosphorus removal ratio ΔP.

[Chemical Formula 12]

$$2Fe_2O_3(s)=4FeO(s)+O_2(g) \quad (k)$$

TABLE 12-1

| | Partial reduction treatment | | | Nitriding dephosphorization | | | |
|---|---|---|---|---|---|---|---|
| | Temp. Tr | Reducing agent ratio M/O (amount-of-substance ratio) | Reduction ratio | Temp. $T_{DP}$ | Gas composition [vol %] | | |
| No. | [° C.] | | $R_{Fe}$ [%] | [° C.] | CO | $CO_2$ | $N_2$ |
| 1 | — | — | — | 1000 | 13.38 | 6.62 | 80 |
| 2 | 300 | 0.11 | 3.2 | 1000 | 13.42 | 6.58 | 80 |
| 3 | 300 | 0.23 | 6.3 | 1000 | 13.45 | 6.55 | 80 |
| 4 | 300 | 0.33 | 9.9 | 1000 | 13.38 | 6.62 | 80 |
| 5 | 300 | 0.45 | 12.6 | 1000 | 13.42 | 6.58 | 80 |
| 6 | 300 | 0.56 | 15.8 | 1000 | 13.38 | 6.62 | 80 |
| 7 | 300 | 0.67 | 18.9 | 1000 | 13.40 | 6.60 | 80 |
| 8 | 300 | 0.78 | 22.0 | 1000 | 13.42 | 6.58 | 80 |
| 9 | 300 | 0.89 | 25.2 | 1000 | 13.45 | 6.55 | 80 |
| 10 | 300 | 1.00 | 28.2 | 1000 | 13.44 | 6.56 | 80 |
| 11 | 300 | 1.12 | 33.0 | 1000 | 13.44 | 6.56 | 80 |
| 12 | 300 | 1.22 | 36.3 | 1000 | 13.38 | 6.62 | 80 |
| 13 | 300 | 1.34 | 39.6 | 1000 | 13.39 | 6.61 | 80 |

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $\log P_{O2}$ | ΔP [%] | after treatment | Remarks |
| 1 | 2.02 | 1.72E−15 | −14.77 | 45 | Granular | Comparative Example |
| 2 | 2.04 | 1.69E−15 | −14.77 | 50 | Granular | Inventive Example |
| 3 | 2.05 | 1.67E−15 | −14.78 | 53 | Granular | Inventive Example |
| 4 | 2.02 | 1.72E−15 | −14.77 | 65 | Granular | Inventive Example |
| 5 | 2.04 | 1.68E−15 | −14.77 | 71 | Granular | Inventive Example |
| 6 | 2.02 | 1.72E−15 | −14.77 | 71 | Granular | Inventive Example |
| 7 | 2.03 | 1.71E−15 | −14.77 | 72 | Granular | Inventive Example |
| 8 | 2.04 | 1.69E−15 | −14.77 | 71 | Granular | Inventive Example |
| 9 | 2.05 | 1.67E−15 | −14.78 | 70 | Granular | Inventive Example |
| 10 | 2.05 | 1.67E−15 | −14.78 | 71 | Granular | Inventive Example |
| 11 | 2.05 | 1.67E−15 | −14.78 | 60 | Granular | Inventive Example |
| 12 | 2.02 | 1.72E−15 | −14.77 | 54 | Granular | Inventive Example |
| 13 | 2.03 | 1.71E−15 | −14.77 | 50 | Granular | Inventive Example |

TABLE 12-2

| | Partial reduction treatment | | | Nitriding dephosphorization | | | |
|---|---|---|---|---|---|---|---|
| | Temp. Tr | Reducing agent ratio M/O (amount-of-substance ratio) | Reduction ratio | Temp. $T_{DP}$ | Gas composition [vol %] | | |
| No. | [° C.] | | $R_{Fe}$ [%] | [° C.] | CO | $CO_2$ | $N_2$ |
| 14 | 800 | 0.11 | 3.5 | 1000 | 13.43 | 6.57 | 80 |
| 15 | 800 | 0.23 | 7.0 | 1000 | 13.38 | 6.62 | 80 |
| 16 | 800 | 0.33 | 10.6 | 1000 | 13.40 | 6.60 | 80 |
| 17 | 800 | 0.45 | 14.1 | 1000 | 13.40 | 6.60 | 80 |
| 18 | 800 | 0.56 | 17.8 | 1000 | 13.39 | 6.61 | 80 |
| 19 | 800 | 0.67 | 21.1 | 1000 | 13.42 | 6.58 | 80 |
| 20 | 800 | 0.78 | 24.2 | 1000 | 13.45 | 6.55 | 80 |
| 21 | 800 | 0.89 | 28.1 | 1000 | 13.44 | 6.56 | 80 |
| 22 | 800 | 1.00 | 31.4 | 1000 | 13.40 | 6.60 | 80 |
| 23 | 800 | 1.12 | 35.1 | 1000 | 13.39 | 6.61 | 80 |
| 24 | 800 | 1.22 | 38.6 | 1000 | 13.40 | 6.60 | 80 |
| 25 | 800 | 1.34 | 42.1 | 1000 | 13.42 | 6.58 | 80 |

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $\log P_{O2}$ | ΔP [%] | after treatment | Remarks |
| 14 | 2.05 | 1.68E−15 | −14.78 | 50 | Granular | Inventive Example |
| 15 | 2.02 | 1.72E−15 | −14.77 | 53 | Granular | Inventive Example |

TABLE 12-2-continued

| | | | | | | |
|---|---|---|---|---|---|---|
| 16 | 2.03 | 1.71E−15 | −14.77 | 71 | Granular | Inventive Example |
| 17 | 2.03 | 1.71E−15 | −14.77 | 72 | Granular | Inventive Example |
| 18 | 2.03 | 1.71E−15 | −14.77 | 71 | Granular | Inventive Example |
| 19 | 2.04 | 1.69E−15 | −14.77 | 71 | Granular | Inventive Example |
| 20 | 2.05 | 1.67E−15 | −14.78 | 72 | Granular | Inventive Example |
| 21 | 2.05 | 1.67E−15 | −14.78 | 72 | Granular | Inventive Example |
| 22 | 2.03 | 1.71E−15 | −14.77 | 70 | Granular | Inventive Example |
| 23 | 2.03 | 1.71E−15 | −14.77 | 55 | Granular | Inventive Example |
| 24 | 2.03 | 1.71E−15 | −14.77 | 51 | Granular | Inventive Example |
| 25 | 2.04 | 1.69E−15 | −14.77 | 48 | Granular | Inventive Example |

TABLE 12-3

| | Partial reduction treatment | | | Nitriding dephosphorization | | | |
|---|---|---|---|---|---|---|---|
| | | Reducing agent | | | | | |
| | Temp. Tr | ratio M/O (amount-of- | Reduction ratio | Temp. $T_{DP}$ | Gas composition [vol %] | | |
| No. | [° C.] | substance ratio) | $R_{Fe}$ [%] | [° C.] | CO | $CO_2$ | $N_2$ |
| 26 | 1000 | 0.11 | 3.6 | 1000 | 13.40 | 6.60 | 80 |
| 27 | 1000 | 0.23 | 7.2 | 1000 | 13.39 | 6.61 | 80 |
| 28 | 1000 | 0.33 | 11.0 | 1000 | 13.40 | 6.60 | 80 |
| 29 | 1000 | 0.45 | 13.8 | 1000 | 13.41 | 6.59 | 80 |
| 30 | 1000 | 0.56 | 17.4 | 1000 | 13.40 | 6.60 | 80 |
| 31 | 1000 | 0.67 | 21.1 | 1000 | 13.43 | 6.57 | 80 |
| 32 | 1000 | 0.78 | 25.2 | 1000 | 13.39 | 6.61 | 80 |
| 33 | 1000 | 0.89 | 28.3 | 1000 | 13.42 | 6.58 | 80 |
| 34 | 1000 | 1.00 | 31.9 | 1000 | 13.39 | 6.61 | 80 |
| 35 | 1000 | 1.12 | 35.6 | 1000 | 13.43 | 6.57 | 80 |
| 36 | 1000 | 1.22 | 37.3 | 1000 | 13.41 | 6.59 | 80 |
| 37 | 1000 | 1.34 | 38.0 | 1000 | 13.43 | 6.57 | 80 |

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $\log P_{O2}$ | ΔP [%] | after treatment | Remarks |
| 26 | 2.03 | 1.71E−15 | −14.77 | 50 | Granular | Inventive Example |
| 27 | 2.03 | 1.71E−15 | −14.77 | 53 | Granular | Inventive Example |
| 28 | 2.03 | 1.71E−15 | −14.77 | 70 | Granular | Inventive Example |
| 29 | 2.04 | 1.69E−15 | −14.77 | 71 | Granular | Inventive Example |
| 30 | 2.03 | 1.71E−15 | −14.77 | 71 | Granular | Inventive Example |
| 31 | 2.05 | 1.68E−15 | −14.78 | 72 | Granular | Inventive Example |
| 32 | 2.03 | 1.71E−15 | −14.77 | 72 | Granular | Inventive Example |
| 33 | 2.04 | 1.69E−15 | −14.77 | 73 | Granular | Inventive Example |
| 34 | 2.03 | 1.71E−15 | −14.77 | 72 | Granular | Inventive Example |
| 35 | 2.05 | 1.68E−15 | −14.78 | 57 | Granular | Inventive Example |
| 36 | 2.04 | 1.69E−15 | −14.77 | 52 | Granular | Inventive Example |
| 37 | 2.05 | 1.68E−15 | −14.78 | 50 | Granular | inventive Example |

TABLE 12-4

| | Partial reduction treatment | | | Nitriding dephosphorization | | | |
|---|---|---|---|---|---|---|---|
| | | Reducing agent | | | | | |
| | Temp. Tr | ratio M/O (amount-of- | Reduction ratio | Temp. $T_{DP}$ | Gas composition [vol %] | | |
| No. | [° C.] | substance ratio) | $R_{Fe}$ [%] | [° C.] | CO | $CO_2$ | $N_2$ |
| 38 | 1300 | 0.11 | 3.7 | 1000 | 13.43 | 6.57 | 80 |
| 39 | 1300 | 0.23 | 7.4 | 1000 | 13.45 | 6.55 | 80 |
| 40 | 1300 | 0.33 | 11.2 | 1000 | 13.44 | 6.56 | 80 |
| 41 | 1300 | 0.45 | 14.6 | 1000 | 13.42 | 6.58 | 80 |
| 42 | 1300 | 0.56 | 18.3 | 1000 | 13.42 | 6.58 | 80 |

TABLE 12-4-continued

| | | | | | | | |
|---|---|---|---|---|---|---|---|
| 43 | 1300 | 0.67 | 21.9 | 1000 | 13.40 | 6.60 | 80 |
| 44 | 1300 | 0.78 | 25.6 | 1000 | 13.39 | 6.61 | 80 |
| 45 | 1300 | 0.89 | 29.2 | 1000 | 13.42 | 6.58 | 80 |
| 46 | 1300 | 1.00 | 32.9 | 1000 | 13.43 | 6.57 | 80 |
| 47 | 1300 | 1.12 | 35.8 | 1000 | 13.39 | 6.61 | 80 |
| 48 | 1300 | 1.22 | 38.6 | 1000 | 13.44 | 6.56 | 80 |
| 49 | 1300 | 1.34 | 41.8 | 1000 | 13.44 | 6.56 | 80 |

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $logP_{O2}$ | ΔP [%] | after treatment | Remarks |
| 38 | 2.05 | 1.68E−15 | −14.78 | 50 | Granular | Inventive Example |
| 39 | 2.05 | 1.67E−15 | −14.78 | 54 | Granular | Inventive Example |
| 40 | 2.05 | 1.67E−15 | −14.78 | 69 | Granular | Inventive Example |
| 41 | 2.04 | 1.69E−15 | −14.77 | 71 | Granular | Inventive Example |
| 42 | 2.04 | 1.69E−15 | −14.77 | 72 | Granular | Inventive Example |
| 43 | 2.03 | 1.71E−15 | −14.77 | 73 | Granular | Inventive Example |
| 44 | 2.03 | 1.71E−15 | −14.77 | 73 | Granular | Inventive Example |
| 45 | 2.04 | 1.69E−15 | −14.77 | 73 | Granular | Inventive Example |
| 46 | 2.05 | 1.68E−15 | −14.78 | 68 | Granular | Inventive Example |
| 47 | 2.03 | 1.71E−15 | −14.77 | 54 | Granular | Inventive Example |
| 48 | 2.05 | 1.67E−15 | −14.78 | 50 | Granular | Inventive Example |
| 49 | 2.05 | 1.67E−15 | −14.78 | 47 | Granular | Inventive Example |

TABLE 12-5

| | Partial reduction treatment | | | Nitriding dephosphorization | | | |
|---|---|---|---|---|---|---|---|
| | | Reducing agent | | | Gas composition [vol %] | | |
| No. | Temp. Tr [° C.] | ratio M/O (amount-of-substance ratio) | Reduction ratio $R_{Fe}$ [%] | Temp. $T_{DP}$ [° C.] | CO | $CO_2$ | $N_2$ |
| 50 | 200 | 0.33 | 1.9 | 1000 | 13.38 | 6.62 | 80 |
| 51 | 250 | 0.33 | 2.7 | 1000 | 13,38 | 6.62 | 80 |
| 52 | 300 | 0.33 | 9.9 | 1000 | 13.40 | 6.60 | 80 |
| 53 | 330 | 0.33 | 10.0 | 1000 | 13.43 | 6.57 | 80 |
| 54 | 350 | 0.33 | 10.2 | 1000 | 13.38 | 6.62 | 80 |
| 55 | 400 | 0.33 | 10.3 | 1000 | 13.43 | 6.57 | 80 |
| 56 | 600 | 0.33 | 10.4 | 1000 | 13.44 | 6.56 | 80 |
| 57 | 800 | 0.33 | 10.6 | 1000 | 13.39 | 6.61 | 80 |
| 58 | 1000 | 0.33 | 11.0 | 1000 | 13.38 | 6.62 | 80 |
| 59 | 1200 | 0.33 | 11.2 | 1000 | 13.41 | 6.59 | 80 |
| 60 | 1300 | 0.33 | 11.2 | 1000 | 13.43 | 6,57 | 80 |
| 61 | 1350 | 0.33 | 11.2 | 1000 | 13,41 | 6,59 | 80 |
| 62 | 1400 | 0.33 | 11.2 | 1000 | 13.44 | 6.56 | 80 |

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $logP_{O2}$ | ΔP [%] | after treatment | Remarks |
| 50 | 2.02 | 1.72E−15 | −14.77 | 47 | Granular | Inventive Example |
| 51 | 2.02 | 1.72E−15 | −14.77 | 48 | Granular | Inventive Example |
| 52 | 2.03 | 1.70E−4 5 | −14.77 | 65 | Granular | Inventive Example |
| 53 | 2.05 | 1.68E−15 | −14.78 | 69 | Granular | Inventive Example |
| 54 | 2.02 | 1.72E−15 | −14.77 | 69 | Granular | Inventive Example |
| 55 | 2.05 | 1.68E−15 | −14.78 | 70 | Granular | Inventive Example |
| 56 | 2.05 | 1.67E−15 | −14.78 | 70 | Granular | Inventive Example |
| 57 | 2.03 | 1.7 IE−15 | −14.77 | 71 | Granular | Inventive Example |
| 58 | 2.02 | 1.72E−15 | −14.77 | 70 | Granular | Inventive Example |
| 59 | 2.04 | 1.69E−15 | −14.77 | 70 | Granular | Inventive Example |
| 60 | 2.05 | 1.68E−15 | −14.78 | 69 | Granular | Inventive Example |
| 61 | 2.04 | 1.69E−15 | −14.77 | 23 | Molten state | Comparative Example |
| 62 | 2.05 | 1.67E−15 | −14.78 | 21 | Molten state | Comparative Example |

TABLE 12-6

| | Partial reduction treatment | | | Nitriding dephosphorization | | | |
|---|---|---|---|---|---|---|---|
| | | Reducing agent | | | | | |
| | Temp. Tr | ratio M/O (amount-of- | Reduction ratio | Temp. $T_{DP}$ | Gas composition [vol %] | | |
| No. | [° C.] | substance ratio) | $R_{Fe}$ [%] | [° C.] | CO | $CO_2$ | $N_2$ |
| 63 | 200 | 0.78 | 2.1 | 1000 | 13.42 | 6.58 | 80 |
| 64 | 250 | 0.78 | 3.0 | 1000 | 13.41 | 6.59 | 80 |
| 65 | .300 | 0.78 | 22.0 | 1000 | 13.41 | 6.59 | 80 |
| 66 | 330 | 0.78 | 22.3 | 1000 | 13.41 | 6.59 | 80 |
| 67 | 350 | 0.78 | 22.6 | 1000 | 13.43 | 6.57 | 80 |
| 68 | 400 | 0.78 | 23.0 | 1000 | 13.45 | 6.55 | 80 |
| 69 | 600 | 0.78 | 23.6 | 1000 | 13.40 | 6.60 | 80 |
| 70 | 800 | 0.78 | 24.2 | 1000 | 13.38 | 6.62 | 80 |
| 71 | 1000 | 0.78 | 25.2 | 1000 | 13.43 | 6.57 | 80 |
| 72 | 1200 | 0.78 | 25.3 | 1000 | 13.44 | 6.56 | 80 |
| 73 | 1300 | 0.78 | 25.6 | 1000 | 13.40 | 6.60 | 80 |
| 74 | 1350 | 0.78 | 25.8 | 1000 | 13.41 | 6.59 | 80 |
| 75 | 1400 | 0.78 | 26.1 | 1000 | 13.39 | 6.61 | 80 |

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $\log P_{O2}$ | ΔP [%] | after treatment | Remarks |
| 63 | 2.04 | 1.69E−15 | −14.77 | 48 | Granular | Inventive Example |
| 64 | 2.04 | 1.69E−15 | −14.77 | 49 | Granular | Inventive Example |
| 65 | 2.04 | 1.69E−15 | −14.77 | 72 | Granular | Inventive Example |
| 66 | 2.04 | 1.70E−15 | −14.77 | 72 | Granular | Inventive Example |
| 67 | 2.05 | 1.68E−15 | −14.78 | 72 | Granular | Inventive Example |
| 68 | 2.05 | 1.67E−15 | −14.78 | 72 | Granular | Inventive Example |
| 69 | 2.03 | 1.71E−15 | −14.77 | 72 | Granular | Inventive Example |
| 70 | 2.02 | 1.72E−15 | −14.77 | 72 | Granular | Inv eative Example |
| 71 | 2.05 | 1.68E−15 | −14.78 | 72 | Granular | Inventive Example |
| 72 | 2.05 | 1.67E−15 | −14.78 | 73 | Granular | Inventive Example |
| 73 | 2.03 | 1.71E−15 | −14.77 | 73 | Granular | Inventive Example |
| 74 | 2.04 | 1.69E−15 | −14.77 | 25 | Molten state | Comparative Example |
| 75 | 2.03 | 1.71E−15 | −14.77 | 20 | Molten state | Comparative Example |

TABLE 12-7

| | Partial reduction treatment | | | Nitriding dephosphorization | | | |
|---|---|---|---|---|---|---|---|
| | | Reducing agent | | | | | |
| | Temp. Tr | ratio M/O (amount-of- | Reduction ratio | Temp. $T_{DP}$ | Gas composition [vol %] | | |
| No. | [° C.] | substance ratio) | $R_{Fe}$ [%] | [° C.] | CO | $CO_2$ | $N_2$ |
| 76 | 200 | 1.00 | 9 2 | 1000 | 13.40 | 6.60 | 80 |
| 77 | 250 | 1.00 | 3.1 | 1000 | 13.43 | 6.57 | 80 |
| 78 | 300 | 1.00 | 28.2 | 1000 | 13.44 | 6.56 | 80 |
| 79 | 330 | 1.00 | 28.8 | 1000 | 13.44 | 6.56 | 80 |
| 80 | 350 | 1.00 | 29.0 | 1000 | 13.45 | 6.55 | 80 |
| 81 | 400 | 1.00 | 29.1 | 1000 | 13.39 | 6.61 | 80 |
| 82 | 600 | 1.00 | 30.5 | 1000 | 13.44 | 6.56 | 80 |
| 83 | 800 | 1.00 | 31.4 | 1000 | 13.43 | 6.57 | 80 |
| 84 | 1000 | 1.00 | 31.9 | 1000 | 13.44 | 6.56 | 80 |
| 85 | 1200 | 1.00 | 32.3 | 1000 | 13.40 | 6.60 | 80 |
| 86 | 1300 | 1.00 | 32.9 | 1000 | 13.44 | 6.56 | 80 |
| 87 | 1350 | 1.00 | 33.1 | 1000 | 13.40 | 6.60 | 80 |
| 88 | 1400 | 1.00 | 33.5 | 1000 | 13.41 | 6.59 | 80 |

TABLE 12-7-continued

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $logP_{O2}$ | ΔP [%] | after treatment | Remarks |
| 76 | 2.03 | 1.71E−15 | −14.77 | 48 | Granular | Inventive Example |
| 77 | 2.05 | 1.68E−15 | −14.78 | 49 | Granular | Inventive Example |
| 78 | 2.05 | 1.68E−15 | −14.78 | 71 | Granular | Inventive Example |
| 79 | 2.05 | 1.67E−15 | −14.78 | 71 | Granular | Inventive Example |
| 80 | 2.05 | 1.67E−15 | −14.78 | 69 | Granular | Inventive Example |
| 81 | 2.03 | 1.71E−15 | −14.77 | 70 | Granular | Inventive Example |
| 82 | 2.05 | 1.67E−15 | −14.78 | 71 | Granular | Inventive Example |
| 83 | 2.05 | 1.68E−15 | −14.78 | 70 | Granular | Inventive Example |
| 84 | 2.05 | 1.67E−15 | −14.78 | 72 | Granular | Inventive Example |
| 85 | 2.03 | 1.71E−15 | −14.77 | 72 | Granular | Inventive Example |
| 86 | 2.05 | 1.67E−15 | −14.78 | 68 | Granular | Inventive Example |
| 87 | 2.03 | 1.71E−15 | −14.77 | 90 | Molten state | Comparative Example |
| 88 | 2.04 | 1.69E−15 | −14.77 | 19 | Molten state | Comparative Example |

Treatment Conditions Nos. 50 to 88 in Tables 12-5 to 12-7 show results of operations in which the reducing agent ratio M/O on an amount-of-substance basis was set to 0.33, 0.78, and 1.0 and the reduction treatment temperature Tr was made to vary. Under a reduction treatment condition that the treatment temperature is not higher than Tr=1300° C., as compared with the result of Treatment No. 1 as the comparative example, the phosphorus removal ratio ΔP based on a nitriding dephosphorization treatment is improved. The phosphorus removal ratio ΔP based on the nitriding dephosphorization treatment is high particularly when the reduction treatment temperature Tr is 300 to 1300° C. Conceivably, the reason why an increase in the phosphorus removal ratio ΔP is small when a reduction treatment is performed at lower than Tr=300° C. is that $Fe_2O_3$ was stable at lower than 300° C., and thus a reduction using carbon did not progress, as a result of which $Fe_2O_3$ remained after the reduction treatment at lower than 300° C., so that in a subsequent nitriding dephosphorization treatment, a dephosphorization reaction of the reaction (a) was suppressed until the reaction (e) was completed. On the other hand, conceivably, the reason why the phosphorus removal ratio ΔP is low when the reduction treatment is performed at a temperature higher than Tr 1300° C. is that the melting point $T_m$ of iron ore used this time was 1370° C., so that the iron ore was in a semi-molten or molten state at the reduction treatment temperature Tr of 1350 or 1400° C., which is higher than $0.95 \times T_m$, and as a result of aggregation of a sample, gaps and pores between iron ore particles disappeared to significantly reduce an interfacial area for contacting a nitrogen gas.

Table 13 collectively shows treatment conditions and operation results in a case of treating manganese ore. Here, a reduction ratio of iron oxide and manganese oxide refers to a ratio of an amount of reduced oxygen to total oxygen in the iron oxide and manganese oxide. In Treatments Nos. 90 to 109 in which the reduction treatment temperature Tr is in a range of 200 to 1350° C., as compared with Treatment No. 89 as a comparative example in which a reduction treatment is not performed, the phosphorus removal ratio ΔP is improved. Particularly under treatment conditions (Nos. 96 to 98, 101 to 103, and 106 to 108) that the reducing agent ratio M/O on an amount-of-substance basis is in a range of ⅓ to 1.0 among conditions that the reduction treatment temperature Tr is in a range of 300 to 1350° C., as compared with treatment conditions (Nos. 95, 99, 100, 104, 105, and 109) that the reduction treatment temperature Tr is in the same range and the reducing agent ratio M/O on an amount-of-substance basis is 0.22 or 1.11, the phosphorus removal ratio ΔP is high. Conceivably, the reason why an increase in the phosphorus removal ratio ΔP is small when the reducing agent ratio on an amount-of-substance basis is less than ⅓ is as follows. That is, under the conditions of this example, a carbonaceous material is used as a solid reducing agent, and thus the amount of substance y of an oxygen atom that reacts with 1 mol of the solid reducing agent M is 1 mol. Accordingly, the reducing agent ratio M/O on an amount-of-substance basis required for the above-described reaction (e) and reaction (f) to completely progress rightward (a reduction reaction) is expressed as $\frac{1}{3}y=\frac{1}{3}$. That is, conceivably, when the reducing agent ratio M/O on an amount-of-substance basis was less than ⅓, $Fe_2O_3$ and $Mn_2O_3$ remained after the reduction treatment, and thus in a subsequent nitriding dephosphorization treatment, a dephosphorization reaction of the above-described reaction (a) was suppressed until the above-described reaction (e) and reaction (f) were completed. On the other hand, conceivably, the reason why the phosphorus removal ratio ΔP is low when the reducing agent ratio M/O on an amount-of-substance basis is more than 1.0 is as follows. That is, the reducing agent ratio M/O on an amount-of-substance basis required for the above-described reaction (k) and a reaction (l) expressed by Chemical Formula 13 below to completely progress rightward (a reduction reaction) is expressed as 1/y=1 when considered similarly to the above, That is, conceivably, when the reducing agent ratio M/O on an amount-of-substance basis was more than 1.0, the above-described reaction (b) and reaction (c) progressed rightward (a reduction reaction) to cause metallic iron and metallic manganese to be formed, so that phosphorus was absorbed by the metallic iron or metallic manganese, resulting in lowering the phosphorus removal ratio ΔP.

[Chemical Formula 13]

$$2Mn_2O_3(s)=4MnO(s)+O_2(g) \quad (1)$$

TABLE 13

| | Partial reduction treatment | | | Nitriding dephosphorization | | | |
|---|---|---|---|---|---|---|---|
| | | Reducing agent | | | Gas composition [vol %] | | |
| No. | Temp. Tr [° C.] | ratio M/O (amount-of-substance ratio) | Reduction ratio $R_{Fe}$ [%] | Temp. $T_{DP}$ [° C.] | CO | $CO_2$ | $N_2$ |
| 89 | — | — | — | 1000 | 13.42 | 6.58 | 80 |
| 90 | 200 | 0.22 | 1.8 | 1000 | 13.42 | 6.58 | 80 |
| 91 | 200 | 0.33 | 1.9 | 1000 | 13.42 | 6.58 | 80 |
| 92 | 200 | 0.78 | 2.1 | 1000 | 13.45 | 6.55 | 80 |
| 93 | 200 | 0.99 | 2.2 | 1000 | 13.40 | 6.60 | 80 |
| 94 | 200 | 111 | 2.3 | 1000 | 13.38 | 6.62 | 80 |
| 95 | 300 | 0.22 | 6.8 | 1000 | 13.41 | 6.59 | 80 |
| 96 | 300 | 0.33 | 10.0 | 1000 | 13.40 | 6.60 | 80 |
| 97 | 300 | 0.78 | 22.1 | 1000 | 13.39 | 6.61 | 80 |
| 98 | 300 | 0.99 | 27.9 | 1000 | 13.39 | 6.61 | 80 |
| 99 | 300 | 1.11 | 33.5 | 1000 | 13.43 | 6.57 | 80 |
| 100 | 800 | 0.22 | 7.2 | 1000 | 13.42 | 6.58 | 80 |
| 101 | 800 | 0.33 | 10.5 | 1000 | 13.45 | 6.55 | 80 |
| 102 | 800 | 0.78 | 24.0 | 1000 | 13.39 | 6.61 | 80 |
| 103 | 800 | 0.99 | 31.0 | 1000 | 13.38 | 6.62 | 80 |
| 104 | 800 | 1.11 | 34.3 | 1000 | 13.43 | 6.57 | 80 |
| 105 | 1350 | 0.22 | 7.4 | 1000 | 13.45 | 6.55 | 80 |
| 106 | 1350 | 0.33 | 10.9 | 1000 | 13.42 | 6.58 | 80 |
| 107 | 1350 | 0.78 | 25.6 | 1000 | 13.39 | 6.61 | 80 |
| 108 | 1350 | 0.99 | 29.3 | 1000 | 13.40 | 6.60 | 80 |
| 109 | 1350 | 1.11 | 35.0 | 1000 | 13.45 | 6.55 | 80 |
| 110 | 1450 | 0.22 | 7.5 | 1000 | 13.38 | 6.62 | 80 |
| 111 | 1450 | 0.33 | 11.1 | 1000 | 13.40 | 6.60 | 80 |
| 112 | 1450 | 0.78 | 25.8 | 1000 | 13.42 | 6.58 | 80 |
| 113 | 1450 | 0.99 | 29.9 | 1000 | 13.42 | 6.58 | 80 |
| 114 | 1450 | 1.11 | 35.4 | 1000 | 13.42 | 6.58 | 80 |

| | Nitriding dephosphorization | | | | | |
|---|---|---|---|---|---|---|
| | | Oxygen partial pressure [atm] | | Phosphorus removal rate | Outer appearance | |
| No. | $CO/CO_2$ | $P_{O2}$ | $logP_{O2}$ | ΔP [%] | after treatment | Remarks |
| 89 | 2.04 | 1.69E−15 | −14.77 | 38 | Granular | Comparative Example |
| 90 | 2.04 | 1.69E−15 | −14.77 | 40 | Granular | Inventive Example |
| 91 | 2.04 | 1.69E−15 | −14.77 | 40 | Granular | Inventive Example |
| 92 | 2.05 | 1.67E−15 | −14.78 | 41 | Granular | Inventive Example |
| 93 | 2.03 | 1.71E−15 | −14.77 | 41 | Granular | Inventive Example |
| 94 | 2.02 | 1.72E−15 | −14.77 | 41 | Granular | Inventive Example |
| 95 | 2.04 | 1.69E−15 | −14.77 | 44 | Granular | Inventive Example |
| 96 | 2.03 | 1.71E−15 | −14.77 | 56 | Granular | Inventive Example |
| 97 | 2.03 | 1.71E−15 | −14.77 | 58 | Granular | Inventive Example |
| 98 | 2.03 | 1.71E−15 | −14.77 | 58 | Granular | Inventive Example |
| 99 | 2.05 | 1.68E−15 | −14.78 | 51 | Granular | Inventive Example |
| 100 | 2.04 | 1.69E−15 | −14.77 | 45 | Granular | Inventive Example |
| 101 | 2.05 | 1.67E−15 | −14.78 | 58 | Granular | Inventive Example |
| 102 | 2.03 | 1.71E−15 | −14.77 | 59 | Granular | Inventive Example |
| 103 | 2.02 | 1.72E−15 | −14.77 | 61 | Granular | Inventive Example |
| 104 | 2.05 | 1.68E−15 | −14.78 | 46 | Granular | Inventive Example |
| 105 | 2.05 | 1.67E−15 | −14.78 | 46 | Granular | Inventive Example |
| 106 | 2.04 | 1.69E−15 | −14.77 | 60 | Granular | Inventive Example |
| 107 | 2.03 | 1.71E−15 | −14.77 | 60 | Granular | Inventive Example |
| 108 | 2.03 | 1.71E−15 | −14.77 | 61 | Granular | Inventive Example |
| 109 | 2.05 | 1.67E−15 | −14.78 | 41 | Granular | Inventive Example |
| 110 | 2.02 | 1.72E−15 | −14.77 | 17 | Molten state | Comparative Example |
| 111 | 2.03 | 1.71E−15 | −14.77 | 18 | Molten state | Comparative Example |
| 112 | 2.04 | 1.69E−15 | −14.77 | 19 | Molten state | Comparative Example |
| 113 | 2.04 | 1.69E−15 | −14.77 | 19 | Molten state | Comparative Example |
| 114 | 2.04 | 1.69E−15 | −14.77 | 18 | Molten state | Comparative Example |

Furthermore, conceivably, the reason why an increase in the phosphorus removal ratio ΔP is small when a reduction treatment is performed at lower than the reduction treatment temperature Tr=300° C. is that $Fe_2O_3$ and $Mn_2O_3$ were stable at lower than 300° C., and thus a reduction using carbon did not progress, as a result of which $Fe_2O_3$ remained after the reduction treatment at lower than 300° C., so that in a subsequent nitriding dephosphorization treatment, a dephosphorization reaction of the reaction (a) was suppressed until the reaction (e) and the reaction (f) were completed. On the other hand, conceivably, the reason why the phosphorus removal ratio ΔP is low when the reduction treatment is performed at a temperature higher than Tr=1350° C. is that the melting point $T_m$ of manganese ore used this time was 1425° C. so that the manganese ore was in a molten state at the reduction treatment temperature Tr of 1450° C., which is more than $0.95 \times T_m$, and as a result of aggregation of a sample, gaps and pores between manganese ore particles disappeared to significantly reduce an interfacial area for contacting a nitrogen gas.

Industrial Applicability

The dephosphorization method according to the present invention is not only a method for preferentially removing phosphorus from a phosphorus-containing substance but also a technique for preferentially reducing oxide, and this idea is applicable not only to the field of smelting and refining described merely as an example but also to other technical fields.

The invention claimed is:

1. A method for removing phosphorus from a phosphorus-containing substance, the method comprising:

reacting the phosphorus-containing substance that is used as a raw material for metal smelting or metal refining with a nitrogen-containing gas so that phosphorus in the phosphorus-containing substance is removed through nitriding, and prior to the nitriding removal of phosphorus from the phosphorus-containing substance, performing a reduction treatment in which the phosphorus-containing substance is heated to an unmolten state temperature range so as to react with a reducing agent, thereby reducing a part of metal oxide in the phosphorus-containing substance, wherein:

the reducing agent is a reducing gas or a solid reducing agent; and the reduction treatment using the reducing gas is performed in a range of Expression (2) below:

[Expression 2]

$$1.5 \leq x \times Q \leq 6.0 \quad (2)$$

wherein x denotes twice (-) a volume ratio of an oxygen gas in a standard state required for complete combustion of a unit volume of the reducing gas in the standard state, and Q denotes an amount of the reducing gas ($Nm^3/kg$) used for the reduction treatment with respect to a total amount of iron oxide and manganese oxide in the phosphorus-containing substance.

2. The method for removing phosphorus from a phosphorus-containing substance according to claim 1, wherein the reducing agent has an equilibrium oxygen partial pressure of not more than $10^{-1}$ atm determined by the reducing agent and a product resulting from complete combustion of the reducing agent at a treatment temperature of the reduction treatment.

3. The method for removing phosphorus from a phosphorus-containing substance according to claim 1, wherein a treatment temperature Tr (° C.) of the reduction treatment satisfies a condition of Expression (1) below:

[Expression 1]

$$300 \leq T_r \leq 0.95 \times T_m \quad (1)$$

wherein $T_m$ denotes a melting point (° C.) of the phosphorus-containing substance.

4. The method for removing phosphorus from a phosphorus-containing substance according to claim 1, wherein a reduction ratio of iron oxide and manganese oxide in the phosphorus-containing substance at an end of the reduction treatment is set to not less than 11% and less than 33%, wherein the iron oxide represents any of or a mixture of FeO, $Fe_3O_4$, and $Fe_2O_3$, the manganese oxide represents any of or a mixture of MnO, $Mn_3O_4$, $Mn_2O_3$, and $MnO_2$, and the reduction ratio refers to a ratio of an amount of oxygen removed by reduction to total oxygen in the iron oxide and the manganese oxide.

5. The method for removing phosphorus from a phosphorus-containing substance according to claim 1, wherein the reduction treatment using the solid reducing agent is performed by adjusting a mass WM (kg) of a solid reducing agent M so as to satisfy a condition of Expression (3) below:

[Expression 3]

$$\frac{1}{3y} \leq \frac{W_M}{M_M} \Big/ \left( \frac{W_{Fe_2O_3}}{M_{Fe_2O_3}} + \frac{W_{Mn_2O_3}}{M_{Mn_2O_3}} \right) \leq \frac{1}{y} \quad (3)$$

wherein MM denotes a molar mass (kg/mol) of the solid reducing agent M, $M_{Fe2O3}$ denotes a molar mass (kg/mol) of $Fe_2O_3$, $M_{Mn2O3}$ denotes a molar mass (kg/mol) of $Mn_2O_3$, $W_M$ denotes the mass (kg) of the solid reducing agent M, $W_{Fe2O3}$ denotes a mass (kg) of $Fe_2O_3$ in the phosphorus-containing substance, $W_{Mn2O3}$ denotes a mass (kg) of $Mn_2O_3$ in the phosphorus-containing substance, and y denotes an amount of substance (mol) of an oxygen atom that reacts with 1 mol of the solid reducing agent M.

6. The method for removing phosphorus from a phosphorus-containing substance according to claim 1, wherein the nitriding removal from the phosphorus-containing substance is a treatment in which the phosphorus-containing substance is heated to an unmolten state temperature so as to react with a nitrogen-containing gas having a nitrogen partial pressure of more than 0.15 atm and less than 0.95 atm, thereby removing at least a part of phosphorus in the phosphorus-containing substance therefrom into a gas phase.

7. The method for removing phosphorus from a phosphorus-containing substance according to claim 6, wherein the nitriding removal from the phosphorus-containing substance is a treatment in which the phosphorus-containing substance is heated to the unmolten state temperature so as to react with a nitrogen-containing gas having a nitrogen partial pressure of more than 0.15 atm and less than 0.95 atm, thereby removing at least a part of phosphorus in the phosphorus-containing substance therefrom as a PN gas.

8. A method for manufacturing a raw material for metal smelting or a raw material for metal refining, wherein the method comprises, in manufacturing the raw material for metal smelting or the raw material for metal refining, a step of decreasing a phosphorus content in a phosphorus-containing substance by use of the method for removing phosphorus from a phosphorus-containing substance according to claim 1.

9. A method for manufacturing metal, wherein in manufacturing the metal via at least one of a smelting step or a refining step, the raw material for metal smelting obtained by the method according to claim 8 is used to perform smelting in the smelting step or the raw material for metal refining obtained by the method according to claim 8 is used to perform refining in the refining step.

* * * * *